US008231037B2

(12) United States Patent
Sacks

(10) Patent No.: US 8,231,037 B2
(45) Date of Patent: Jul. 31, 2012

(54) MULTI-MODE STRAP APPARATUS FOR CARRYING BAGS

(76) Inventor: Jerome Elliot Sacks, Lexington, MA (US)

( * ) Notice: Subject to any disclaimer, the term of this patent is extended or adjusted under 35 U.S.C. 154(b) by 771 days.

(21) Appl. No.: 12/002,229

(22) Filed: Dec. 13, 2007

(65) Prior Publication Data

US 2008/0277434 A1 Nov. 13, 2008

Related U.S. Application Data

(60) Provisional application No. 60/875,506, filed on Dec. 18, 2006, provisional application No. 60/899,177, filed on Feb. 3, 2007, provisional application No. 60/958,535, filed on Jul. 7, 2007.

(51) Int. Cl.
*A45F 4/02* (2006.01)
*A45F 3/02* (2006.01)

(52) U.S. Cl. ..... 224/579; 224/153; 224/578; 224/627; 224/600

(58) Field of Classification Search ..... 224/578, 224/579, 153, 643, 627, 600, 580, 602, 607, 224/610, 612, 614–621
See application file for complete search history.

(56) References Cited

U.S. PATENT DOCUMENTS 2,960,137 A * 11/1960 Lipsitz ..... 206/316.2
3,346,155 A * 10/1967 Oechsle ..... 294/141
4,763,763 A * 8/1988 Sadow ..... 190/115
5,415,332 A 5/1995 Kliot
5,577,652 A 11/1996 Cooper
5,639,004 A * 6/1997 Carlton et al. ..... 224/579
5,762,250 A * 6/1998 Carlton et al. ..... 224/579
5,881,932 A 3/1999 Wadden
6,138,881 A 10/2000 Paul
6,220,493 B1 4/2001 Iijima
6,286,461 B1 * 9/2001 Martz ..... 119/497
6,311,884 B1 11/2001 Johnson
6,460,746 B1 * 10/2002 Amram ..... 224/579
7,160,028 B1 * 1/2007 Linday ..... 383/4
7,270,254 B2 * 9/2007 Kakouras ..... 224/150
2007/0175940 A1 8/2007 Sack

OTHER PUBLICATIONS

Beijobags, Catalog on Web Twice as mice See Attch 1.
Eagle creek Coventnbrief ES See Attch 2,3.

* cited by examiner

*Primary Examiner* — Nathan J Newhouse
*Assistant Examiner* — Corey Skurdal
(74) *Attorney, Agent, or Firm* — Jerome E Sacks

(57) ABSTRACT

This invention discloses strap apparatus that is attached to a carrying bag such as a purse, briefcase or message bag. The strap apparatus is constructed from a single flat strap configured as a closed loop. The loop is constrained to each side of the bag at the bottom; the outside first side and inside second side of the strap are also constrained to lie against the sides of the bag near the top; and the inside first side and outside second side are releasably constrained at the sides of the bag at the top. When fully constrained, the bag appears to a casual observer as having a standard single strap. However, when the constraints are released, the two strap segments may be separated and the bag can be put over the shoulder as a backpack. Two other modes, a dual strap and a long strap, are also disclosed.

9 Claims, 40 Drawing Sheets

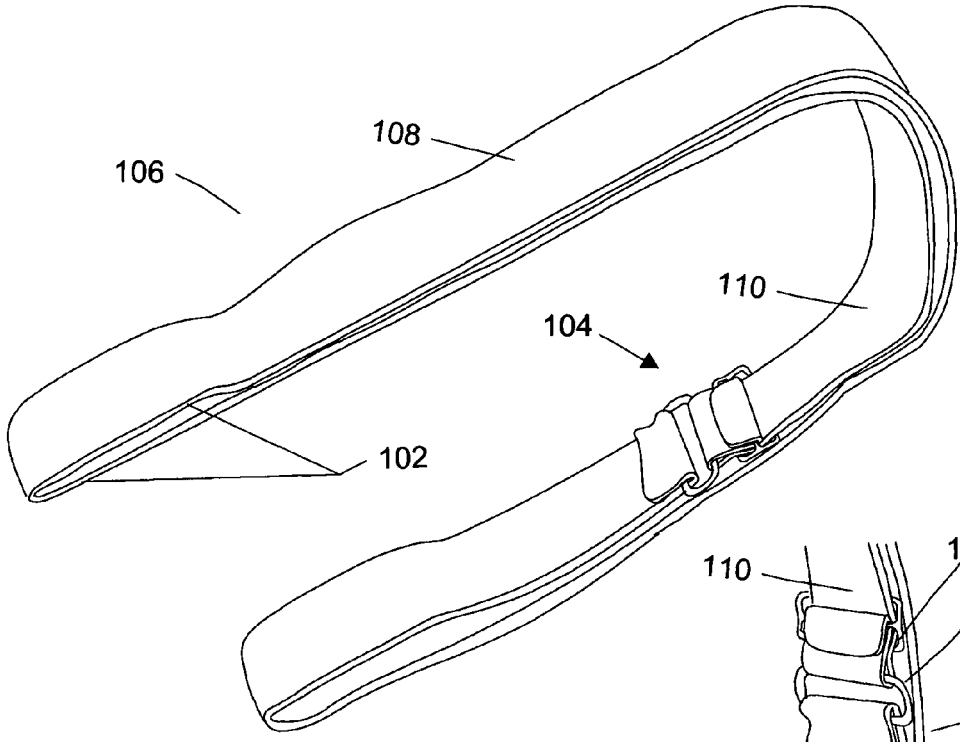
Fig. 1S
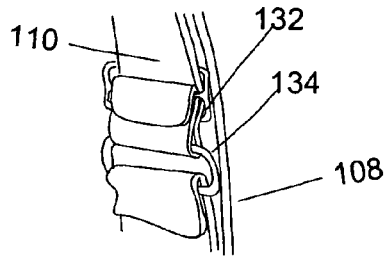
Fig. 1A
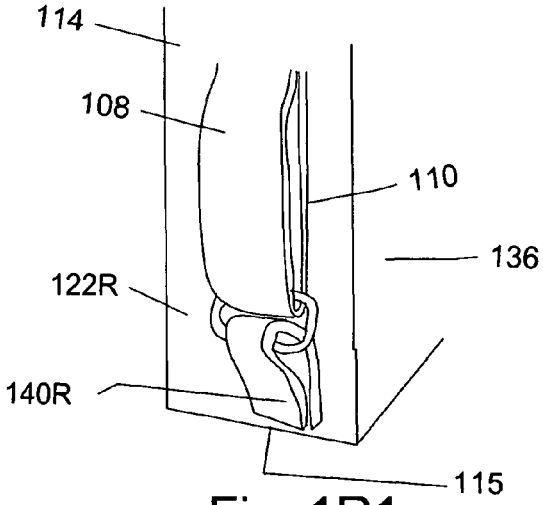
Fig. 1R1
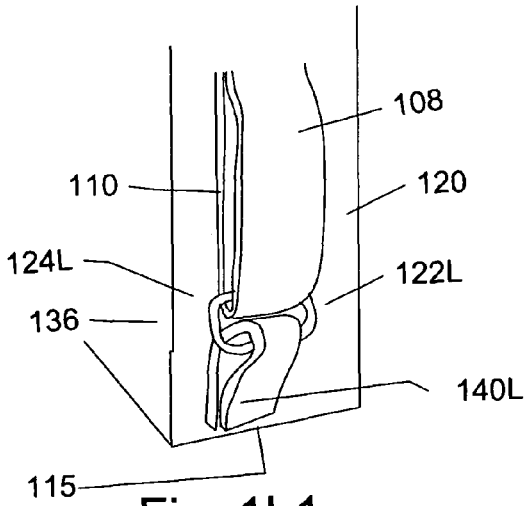
Fig. 1L1

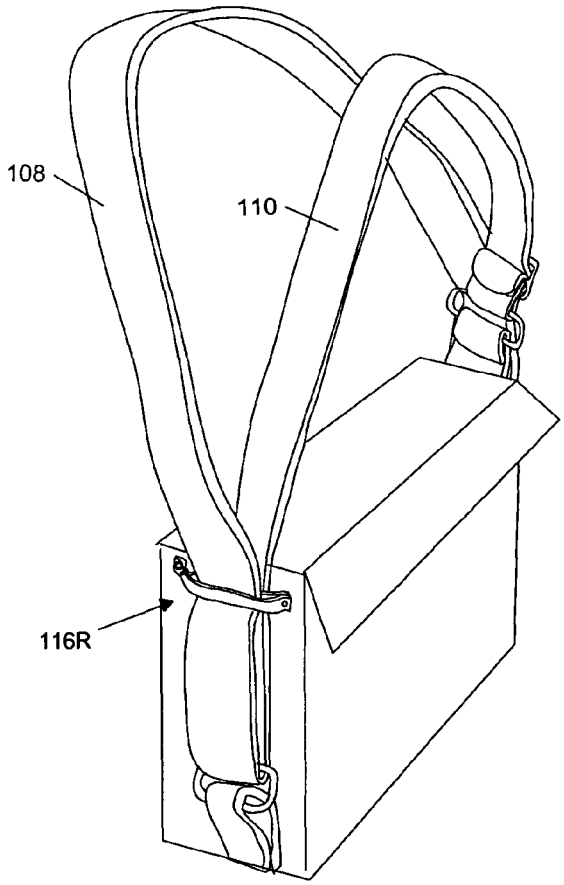
Fig. 3R1
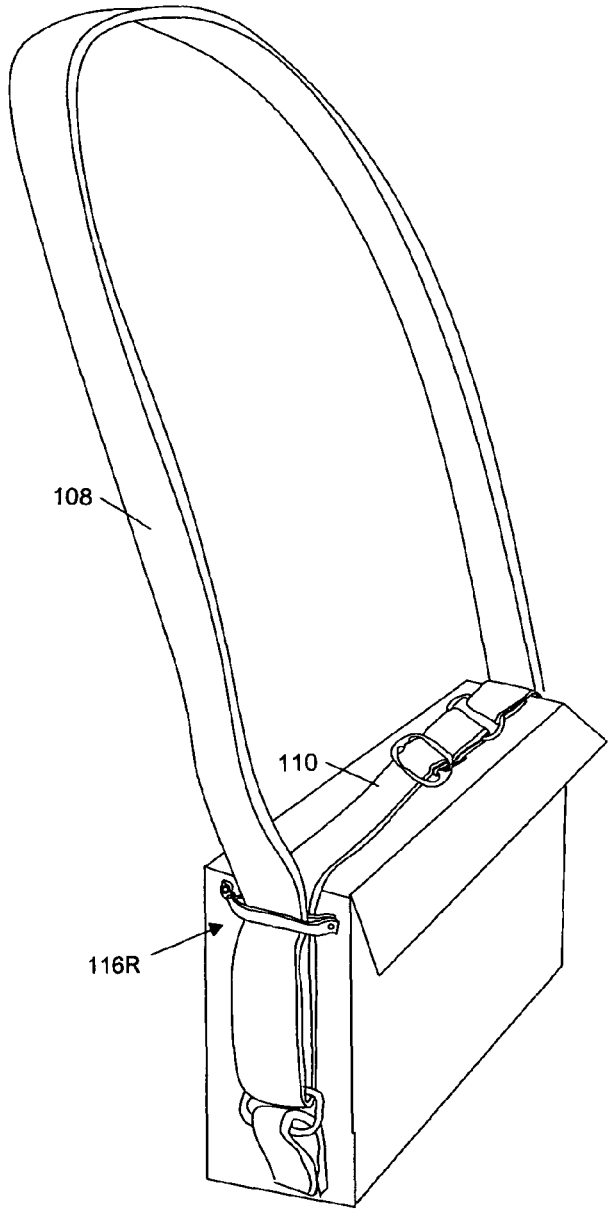
Fig. 3R2

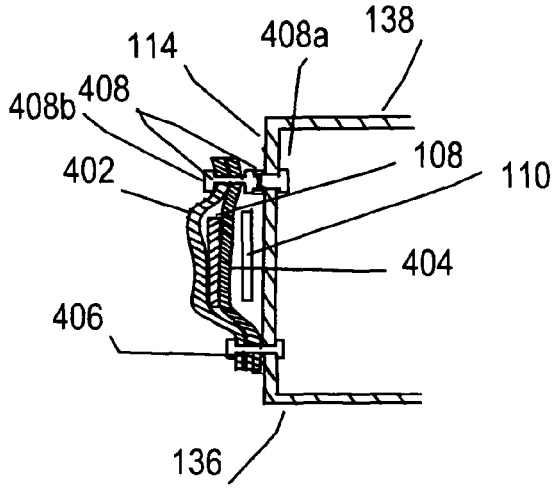
Fig. 4R1
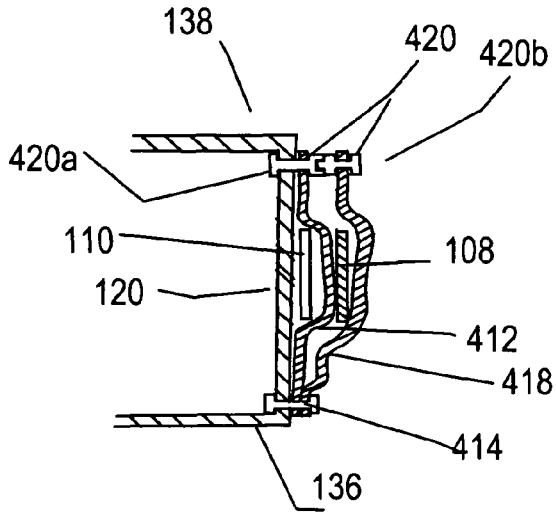
Fig. 4L1
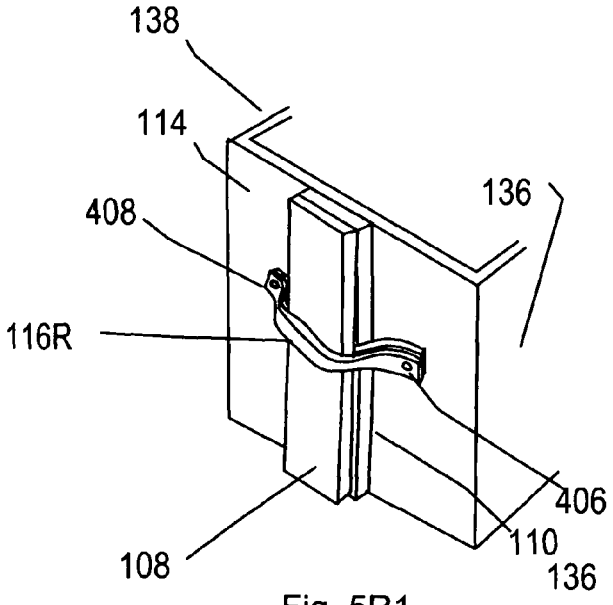
Fig. 5R1
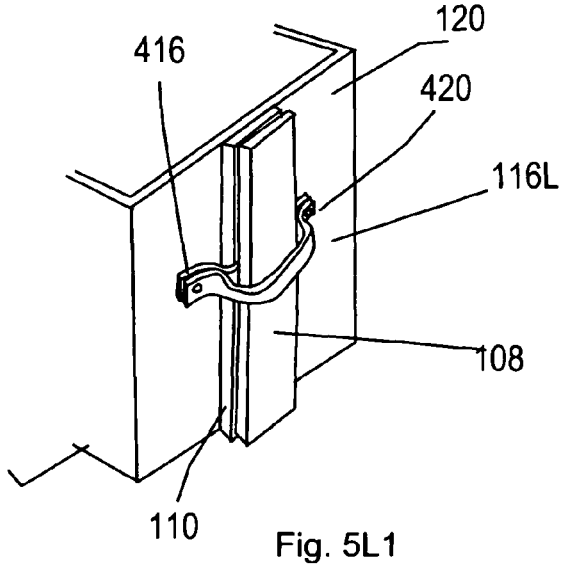
Fig. 5L1

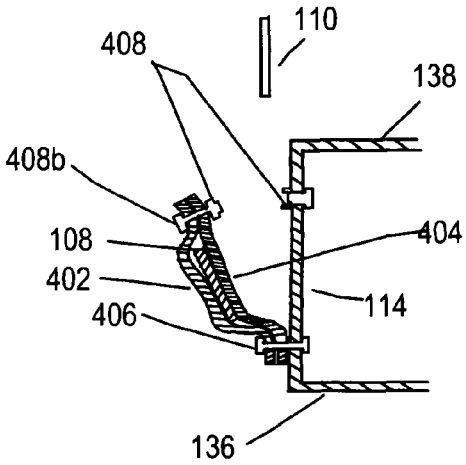
Fig. 4R2
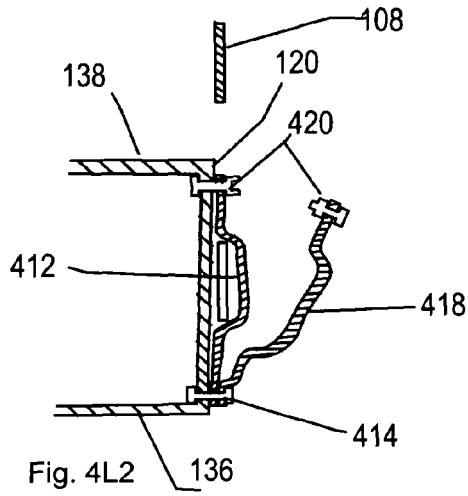
Fig. 4L2
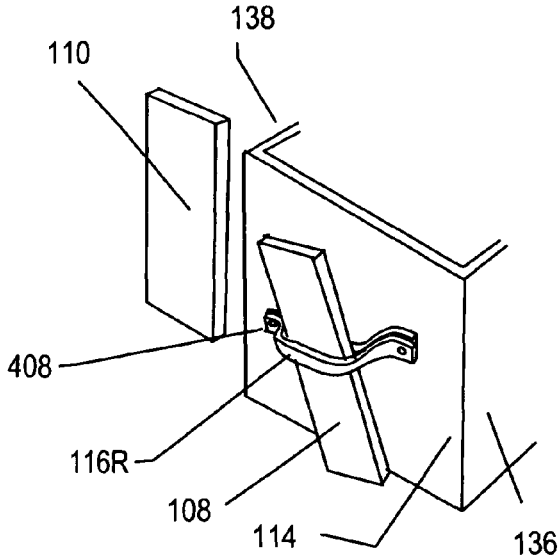
Fig. 5R2
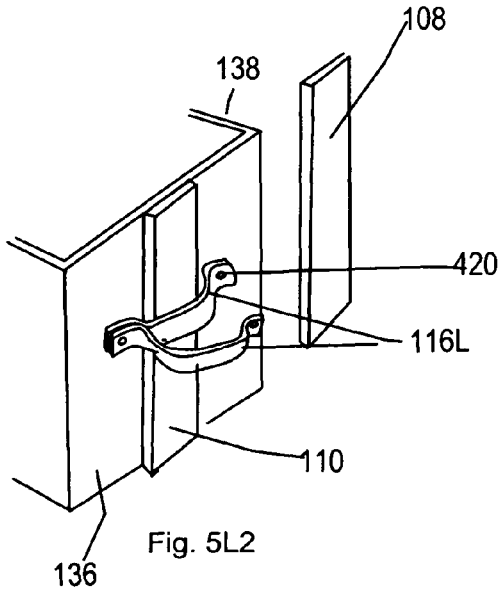
Fig. 5L2

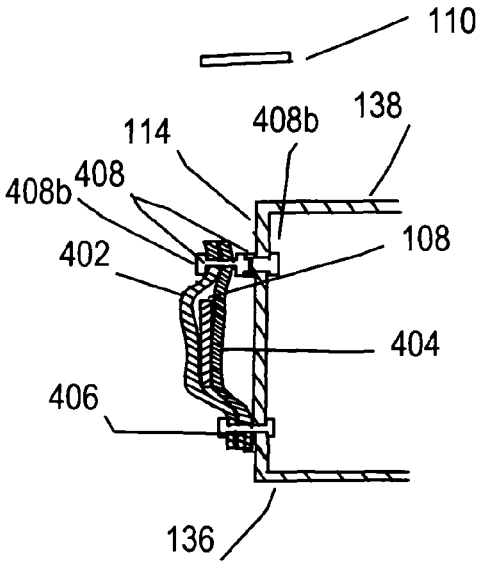
Fig. 4R3
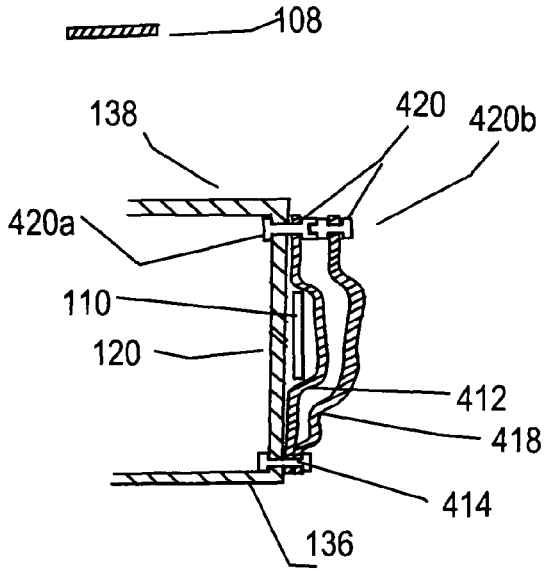
Fig. 4L3
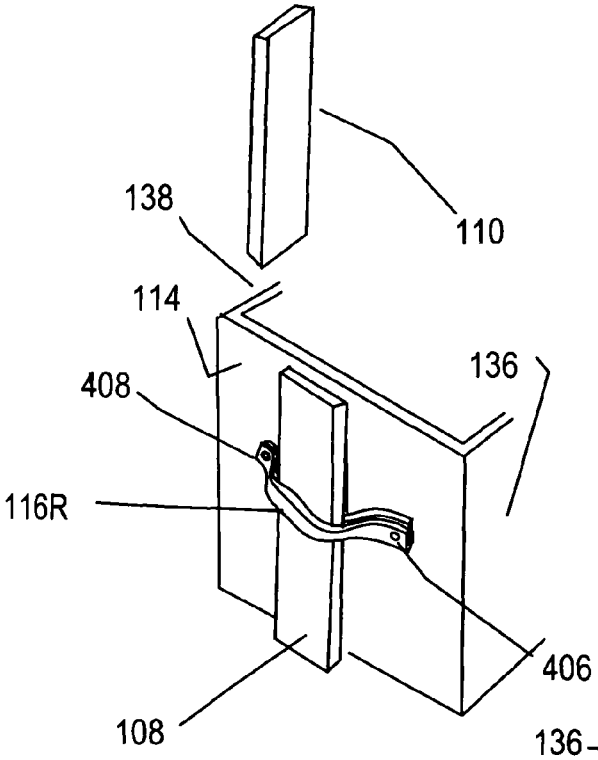
Fig. 5R3
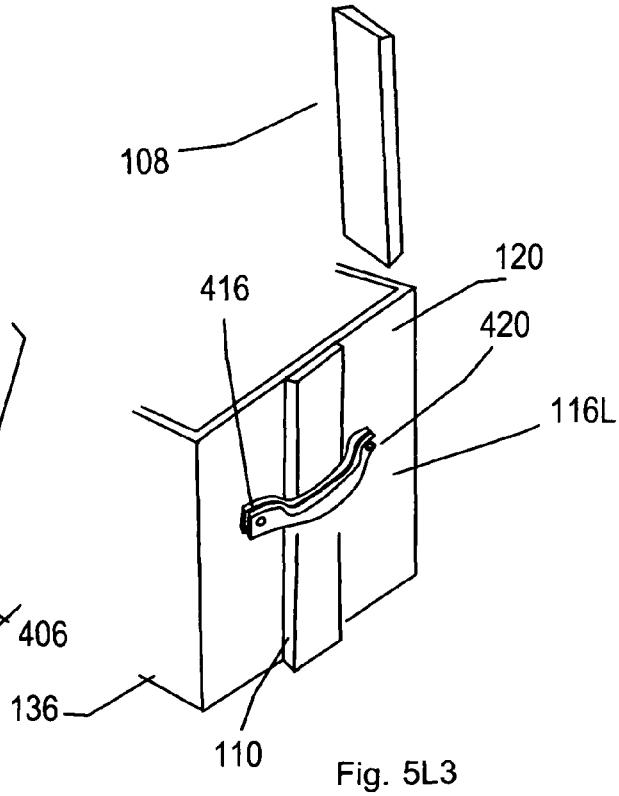
Fig. 5L3

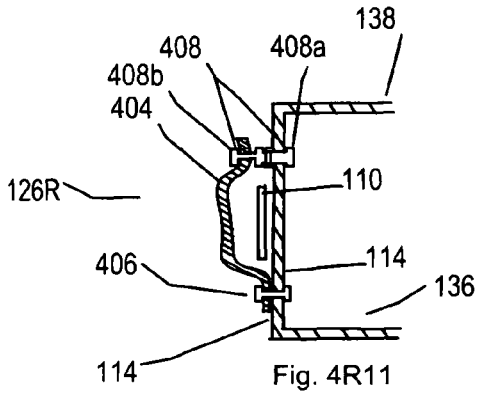
Fig. 4R11
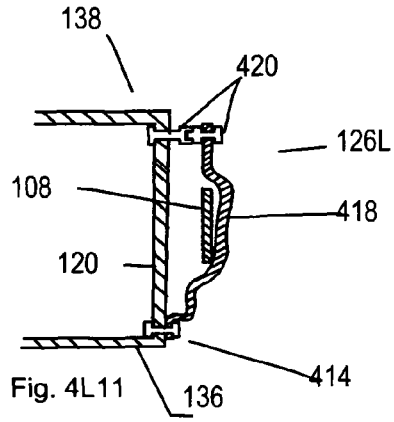
Fig. 4L11
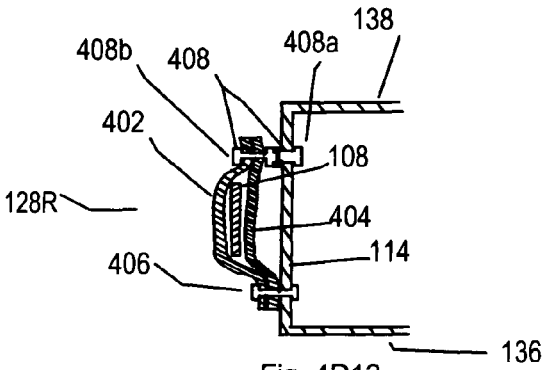
Fig. 4R12
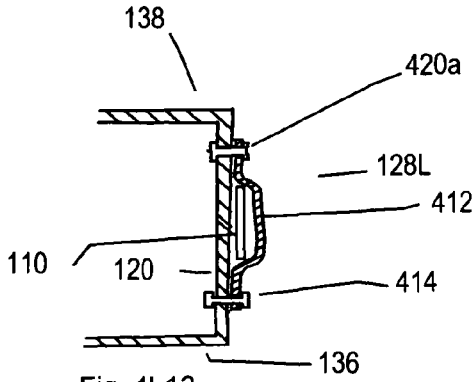
Fig. 4L12

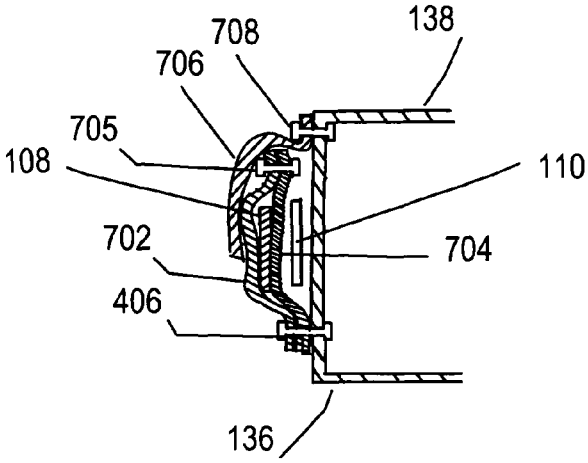
Fig. 7R1
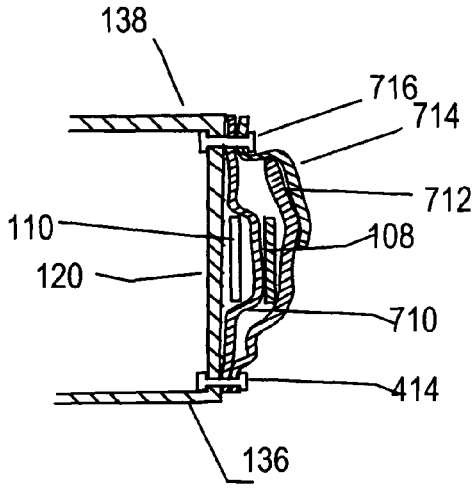
Fig. 7L1
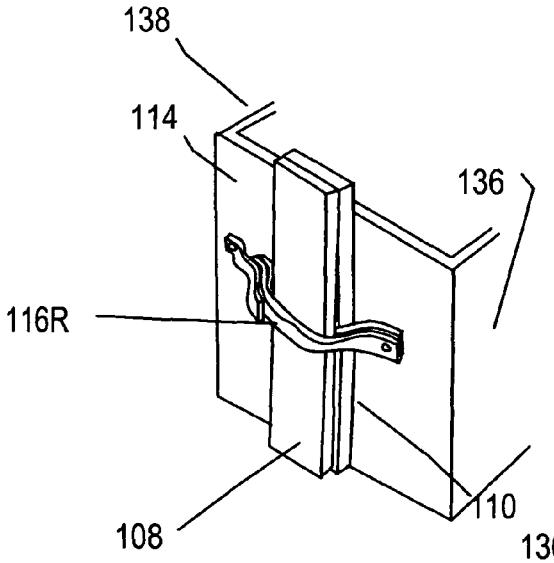
Fig. 8R1
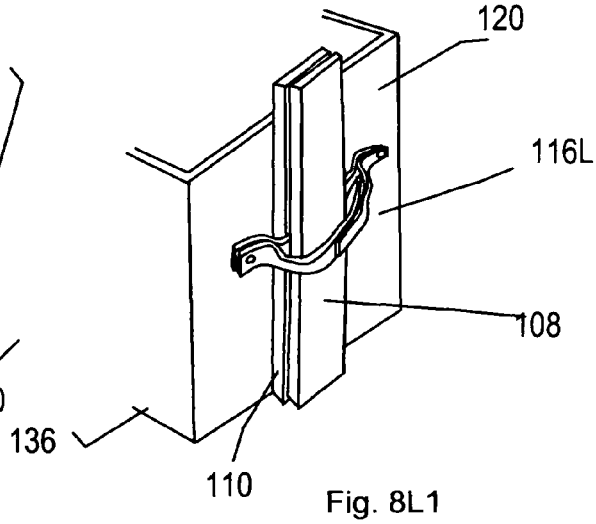
Fig. 8L1

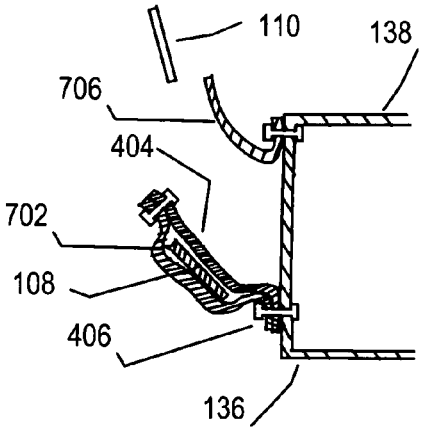
Fig. 7R2
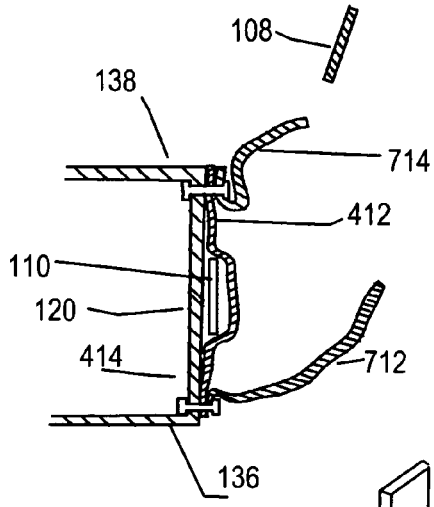
Fig. 7L2
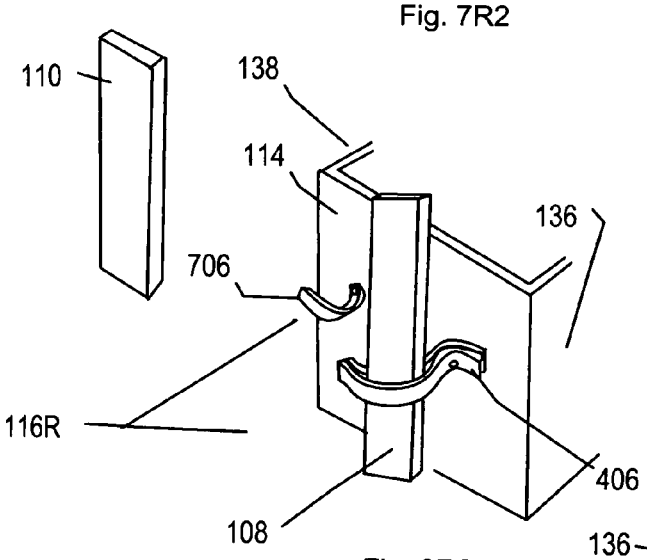
Fig. 8R2
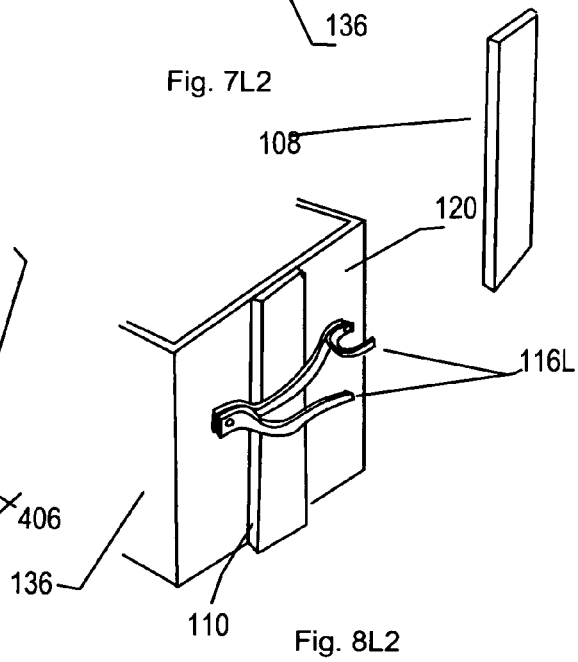
Fig. 8L2

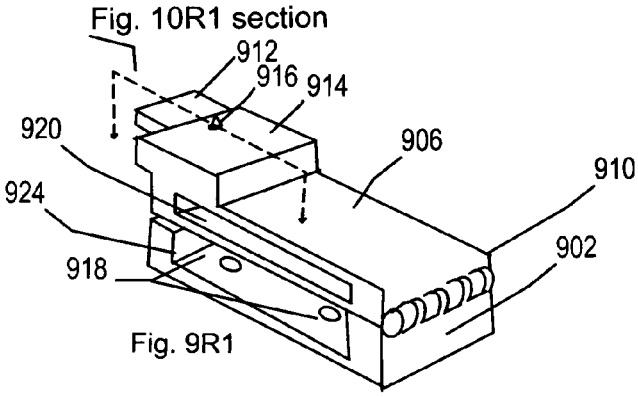
Fig. 9R1
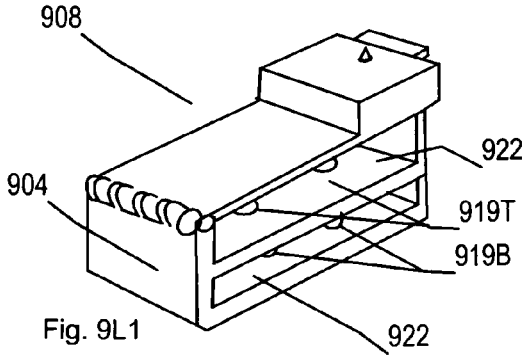
Fig. 9L1
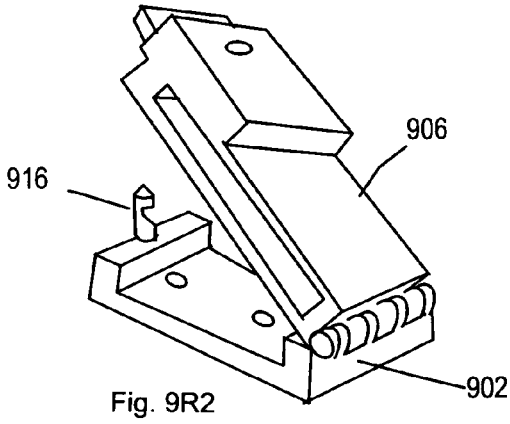
Fig. 9R2
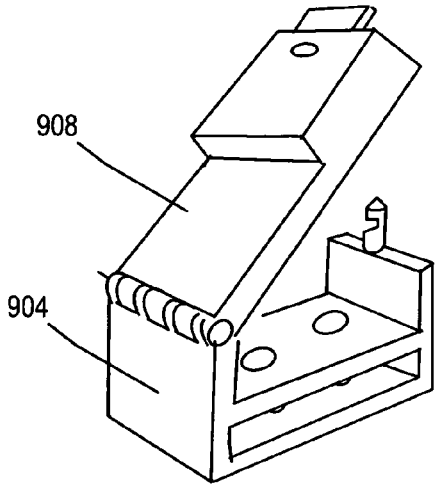
Fig. 9L2

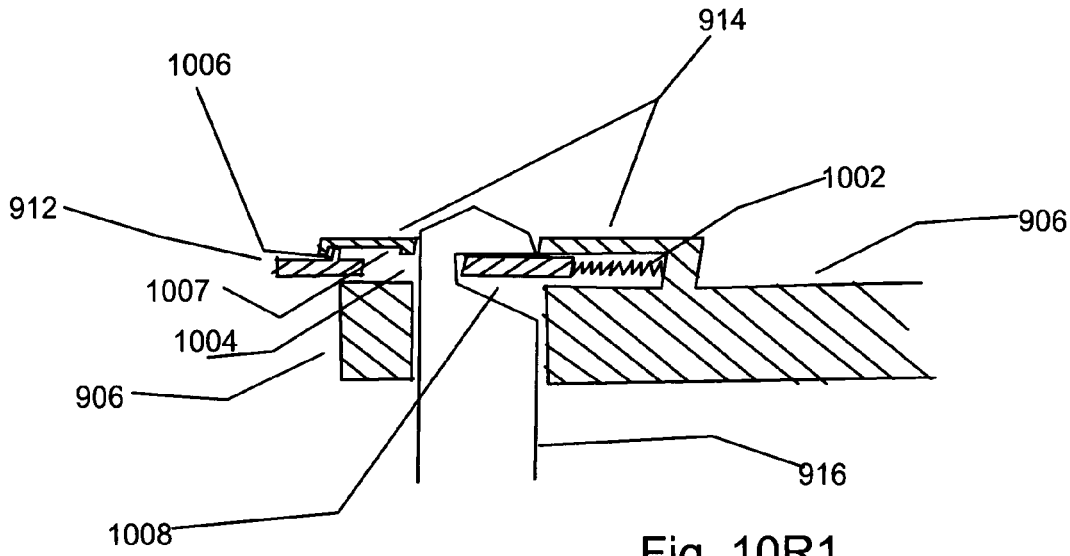
Fig. 10R1
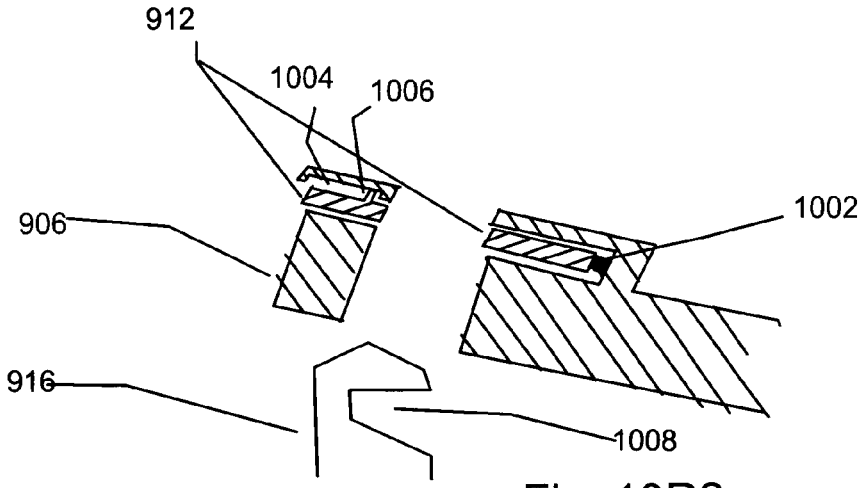
Fig. 10R2
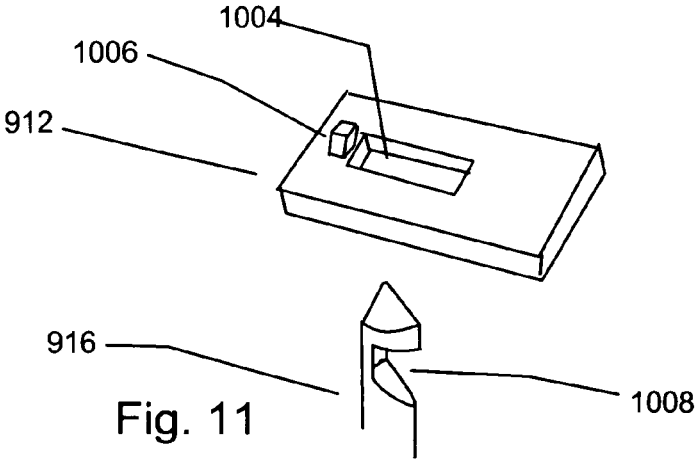
Fig. 11

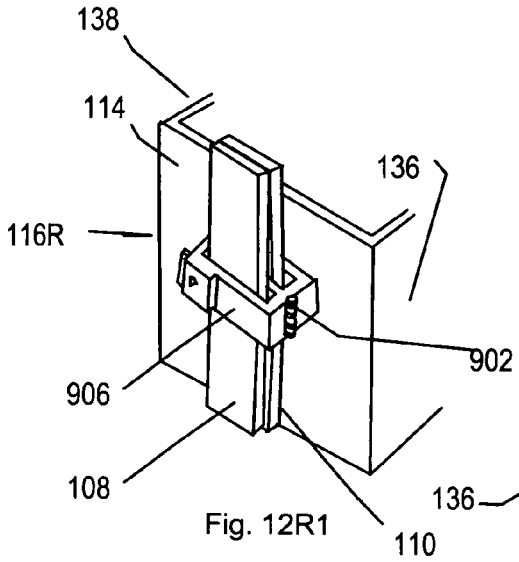
Fig. 12R1
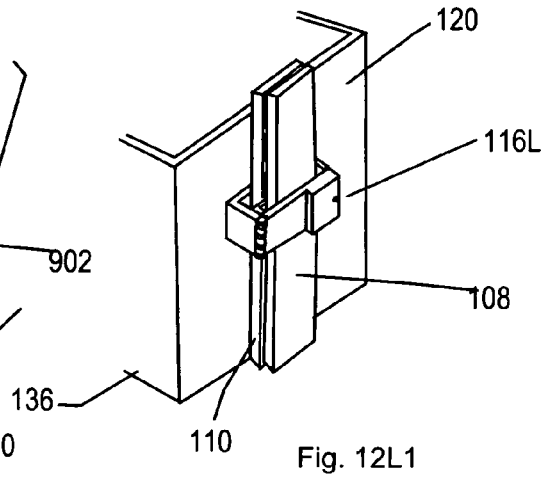
Fig. 12L1
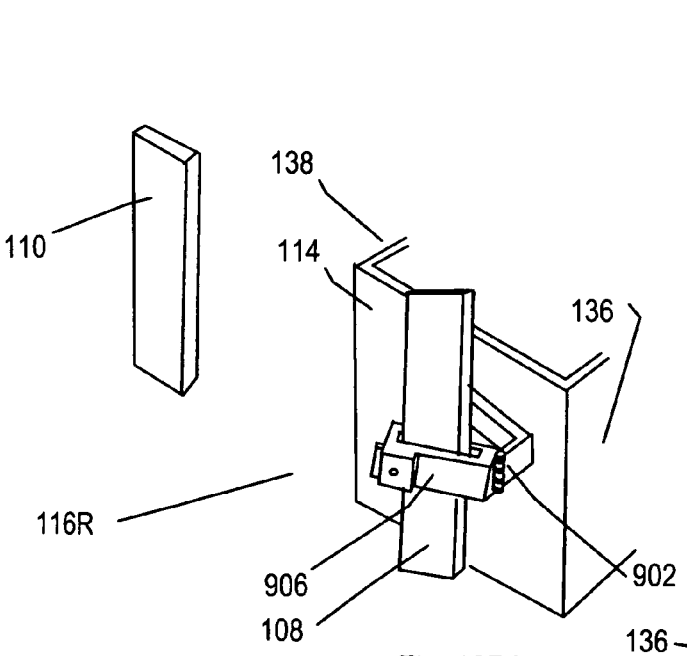
Fig. 12R2
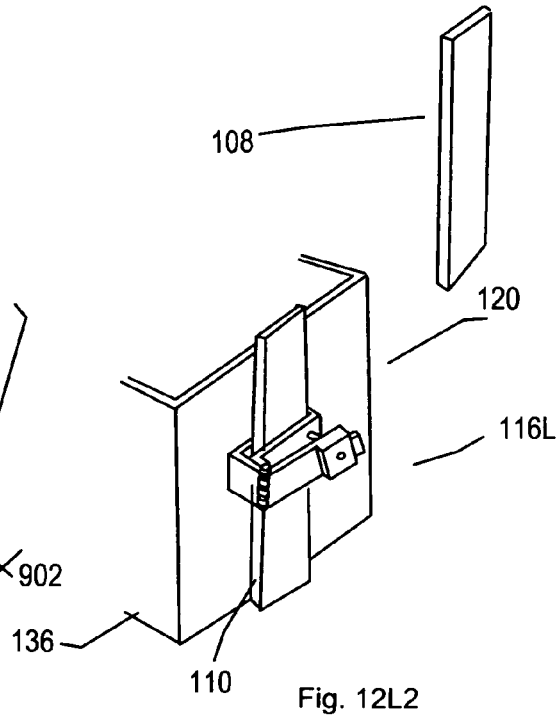
Fig. 12L2

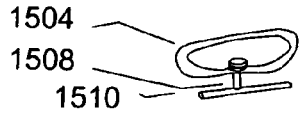
Fig. 15L3
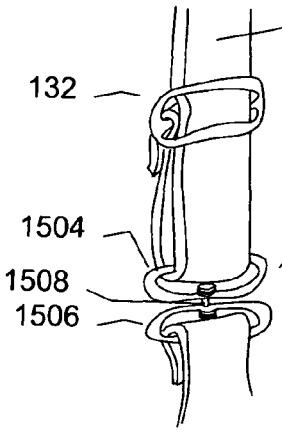
Fig. 15L1
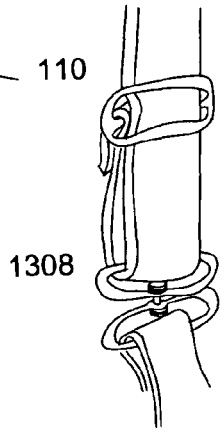
Fig. 15L2
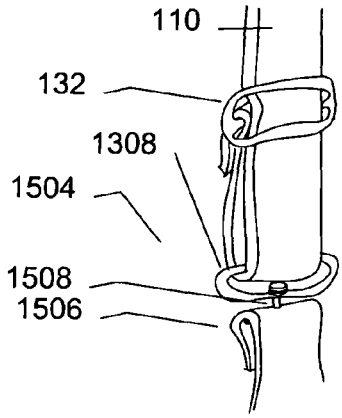
Fig. 15L4
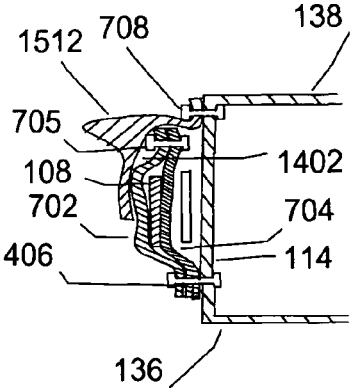
Fig. 15R1
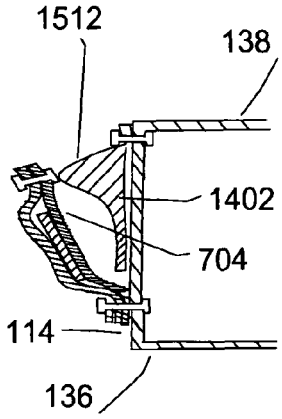
Fig. 15R2
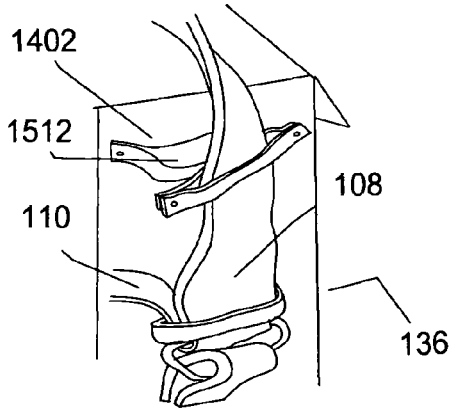
Fig. 15R3

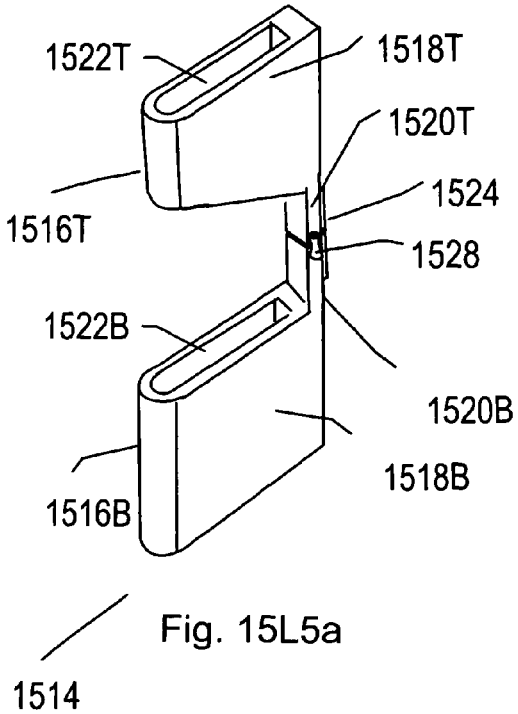
Fig. 15L5a
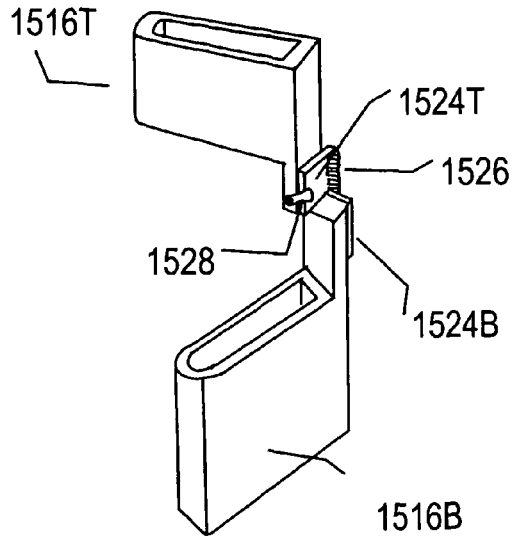
Fig. 15L5b
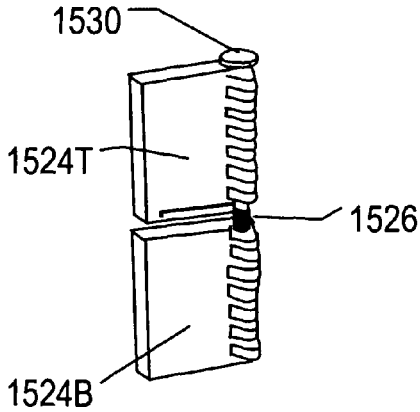
Fig. 15L5c
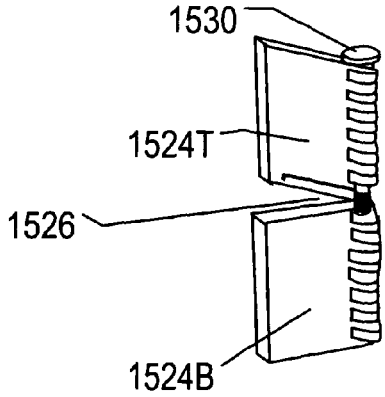
Fig. 15L5d

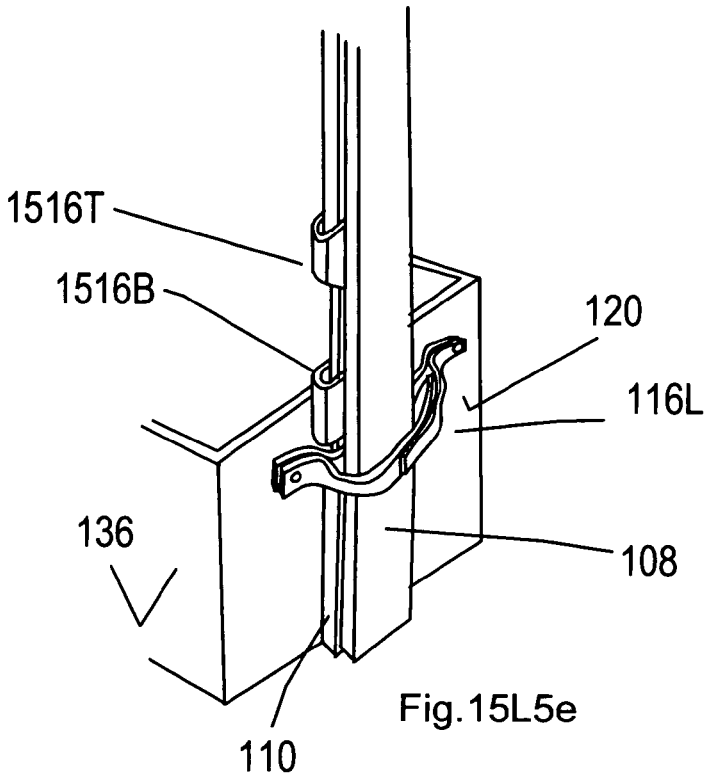
Fig.15L5e
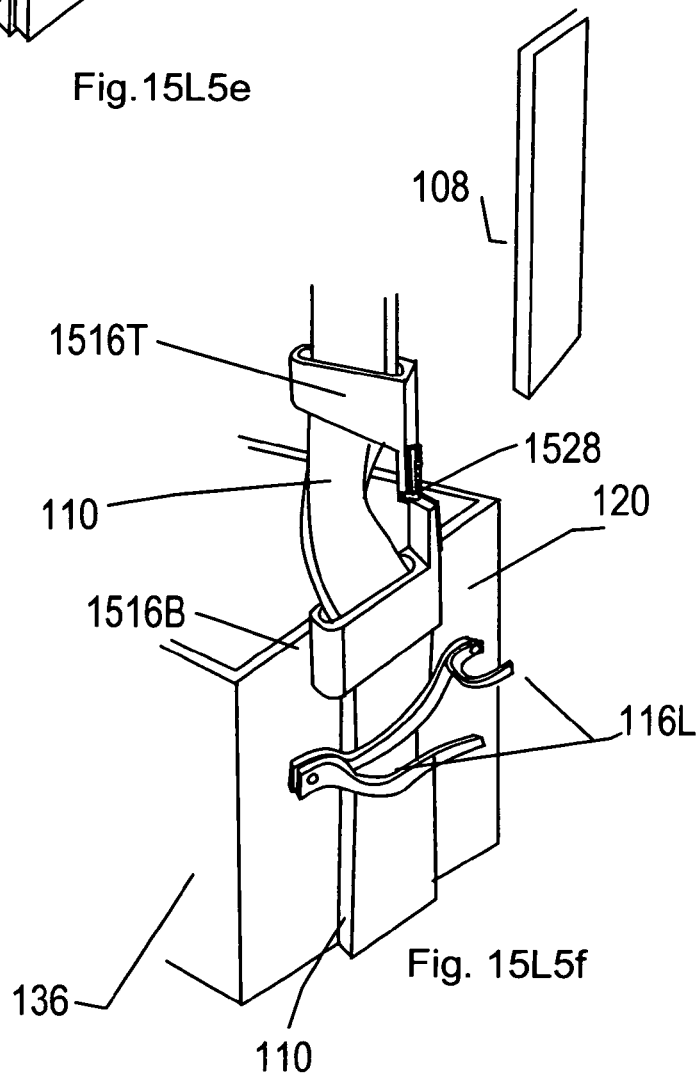
Fig. 15L5f

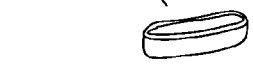
Fig. 16a1
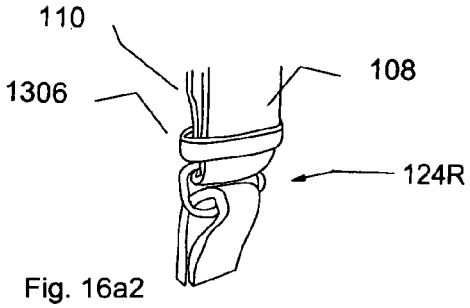
Fig. 16a2
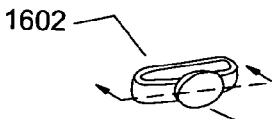
Fig. 16b1
Fig. 16b2 Cross Section
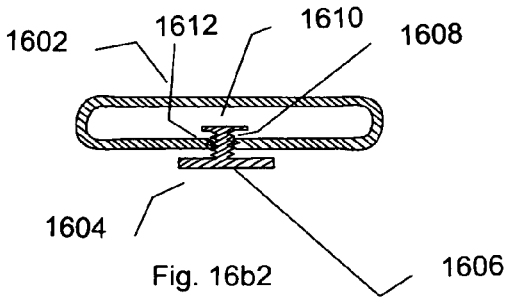
Fig. 16b2
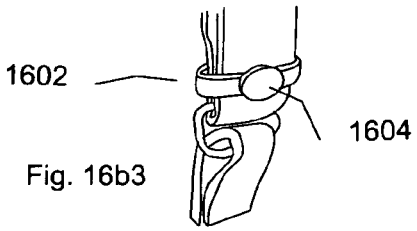
Fig. 16b3

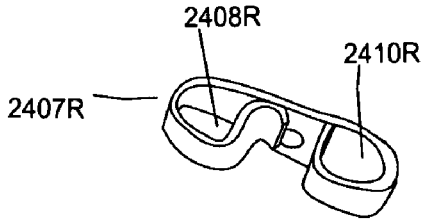
Fig. 27R
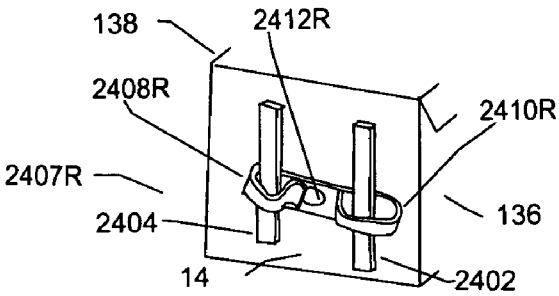
Fig. 27R1
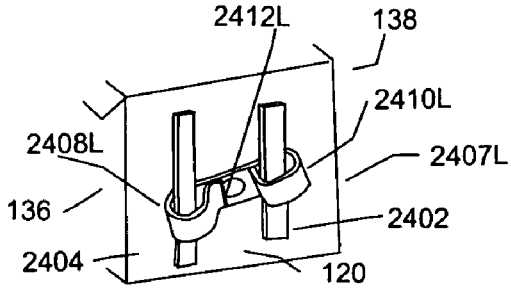
Fig. 27L1
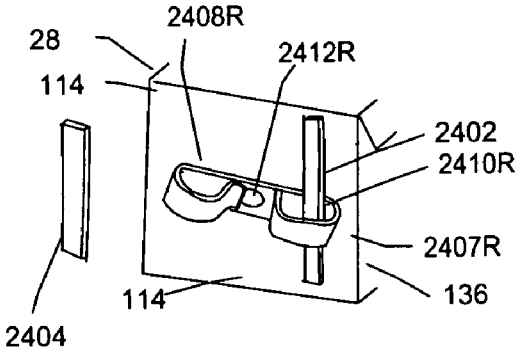
Fig. 27R2
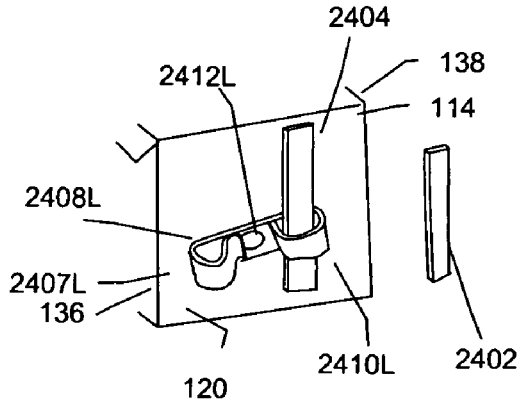
Fig. 27L2

MULTI-MODE STRAP APPARATUS FOR CARRYING BAGS

CROSS-REFERENCES TO RELATED APPLICATIONS

None

This application claims the benefit of the following three provisional patent applications filed by the present inventor:
Ser. No. 60/875,506 filed 2006 Dec. 18,
Ser. No. 60/899,177 filed 2007 Feb. 3,
Ser. No. 60/958,535 filed 2007 Jul. 7.

FEDERALLY SPONSORED RESEARCH

None

SEQUENCE LISTING

None

BACKGROUND

This invention relates to carrying bags, specifically to carrying bags that have straps with a multimode capability.

There exists many strap apparatuses that convert single strap bags to backpacks, or have multimode capabilities. U.S. Pat. No. 6,311,884, Dual Strap System for Conversion of Bags to Backpacks, presents an invention that has a backpack mode that appears to be similar to the backpack mode of my invention. A comparison between the two inventions however yields the other invention's deficiencies. First, their invention does not have a single-strap mode; the user detaches the snap hooks on the single strap that comes with the bag and then attaches the invention to the bag with its own snap hooks. This is much less convenient than my invention. A greater limitation of this other invention is in the way in which it hangs. Since the invention's strap apparatus is attached to the top of the bag, the bag will likely hang below the waist; it will prove quite uncomfortable and thoroughly impractical if worn for any length of time.

U.S. Pat. No. 6,220,493, Multi-Way Bag, has at least six different modes, including a single-strap mode and a backpack mode. However, to convert from one mode to another, the strap needs to be detached from the bag and then reattached in a different way. Furthermore, the many guides, connectors and slits make the appearance of the bag less than desirable.

U.S. Pat. No. 5,881,932, Convertible Bag, has both a single-strap mode and a backpack mode. However, the mechanisms for conversion are rather complex; furthermore if the bag is in a horizontal state when in the backpack mode, then it must be rotated to a vertical state in the conversion to single-strap mode. This is an undesirable feature for many types of bags, especially purses. Finally, the bag itself has hidden compartments that hold the strap, so it is expensive to produce and does not apply to existing bag designs without significant modifications to the bag.

U.S. Pat. No. 5,415,332, Multimode Traveling Bag, has a single-strap mode, a backpack mode, and an over-the-head mode. However it has an entirely different implementation than my invention. It uses a single length of strap, rather than my invention, which uses either a strap in the shape of a closed loop, or two independent straps. Furthermore, it does not apply to bags that open at the top, as is the case of many traveling bags and the majority of purses.

U.S. Pat. No. 5,577,652, Convertible Backpack, is a bag with a single strap attached by snap-hooks. To convert from one mode to another, either the hooks must be detached and then reattached in a different way; or the bag, if it hangs horizontally in the backpack mode, will then hang vertically in the single-strap mode.

U.S. Pat. No. 6,138,881, Convertible Backpack/Shoulder Bag, has a single strap with a zipper along the length of the strap. When the bag is worn in the single-strap mode, the zipper is closed presenting a single strap. To convert to the backpack mode, the zipper is opened, revealing two straps. Although this is a fine approach to the multimode problem, it appears only to apply to bags that are narrower at the top than at the bottom, limiting its use.

Patent application 20070175940, Multiple Configuration Strap Apparatus for Briefcases and other Carrying Bags, by the present inventor, has similar features to the current invention. The strap apparatus is constructed out of a single closed loop, and converts from the single strap mode to the backpack mode without detaching the strap from the bag. However the strap apparatus is attached the bag only the top, and therefore causes the bag to fall lower than the current invention on the users back. Furthermore, it does not accommodate shoulder pads easily.

Eagle Creek used to sell Convertabrief, a bag similar to a briefcase with backpack straps hidden in a pocket. To convert from a single-strap mode to the backpack mode, the hidden straps would be removed from the hidden compartment and reattached using snap hooks. They now sell a product Convertabrief ES, which has these featured and also has additional features like wheels and extendable handles. It is an attractive item for the traveler, but like most of the other inventions with multimode strap capabilities it is difficult to reconfigure.

In the commercial market, Beijobags has a purse/backpack product. According to their website, model Twice as Nice (06287) does convert from a bag to a backpack without having to detach the straps. However their design is not appropriate for briefcases. Furthermore, when held in the purse mode, the straps cross from front/right to back/left and front/left to back/right—not a desirable feature.

My invention has advantages that these other inventions do not have. It is the easiest of all the inventions for switching from one mode to another. It may be added to almost any bag's design and does not detract from the appearance of the bag. Its general nature allows the bag designer to customize the bag's components to meet various feature/price points. It is also the only invention that has the dual-strap mode.

SUMMARY

This invention provides seven embodiments for a carrying bag with up to four modes: a single-strap mode, a backpack mode, an over-the-head mode and a dual-strap mode. The richness of the embodiments and the simplicity afforded the user in switching from one mode to the other makes it an attractive choice for any bag designer. The various embodiments and their modifications and extensions makes the invention applicable to virtually any bag on the market without changing its structure or appearance; including but not limited to purses, evening bags, briefcases, computer bags, musical instruments cases, golf bags and giveaway conference promotional bags. It is the only invention that offers a dual-strap mode. With this mode the bag is worn like a single-strap bag; but has two straps emanating from the bag which hangs at the side of the user towards the user's back, one going over each shoulder, thereby distributing the weight of the bag over two shoulders instead of one. Finally it is a novel design that will facilitate its marketing.

DRAWINGS

There are 40 sheets with 103 figures.

FIGURES FOR EMBODIMENT ONE

FIG. 1S shows the strap and adjustment components configured as a closed loop.

FIG. 1A shows the strap adjustment mechanism.

Figure 1R:
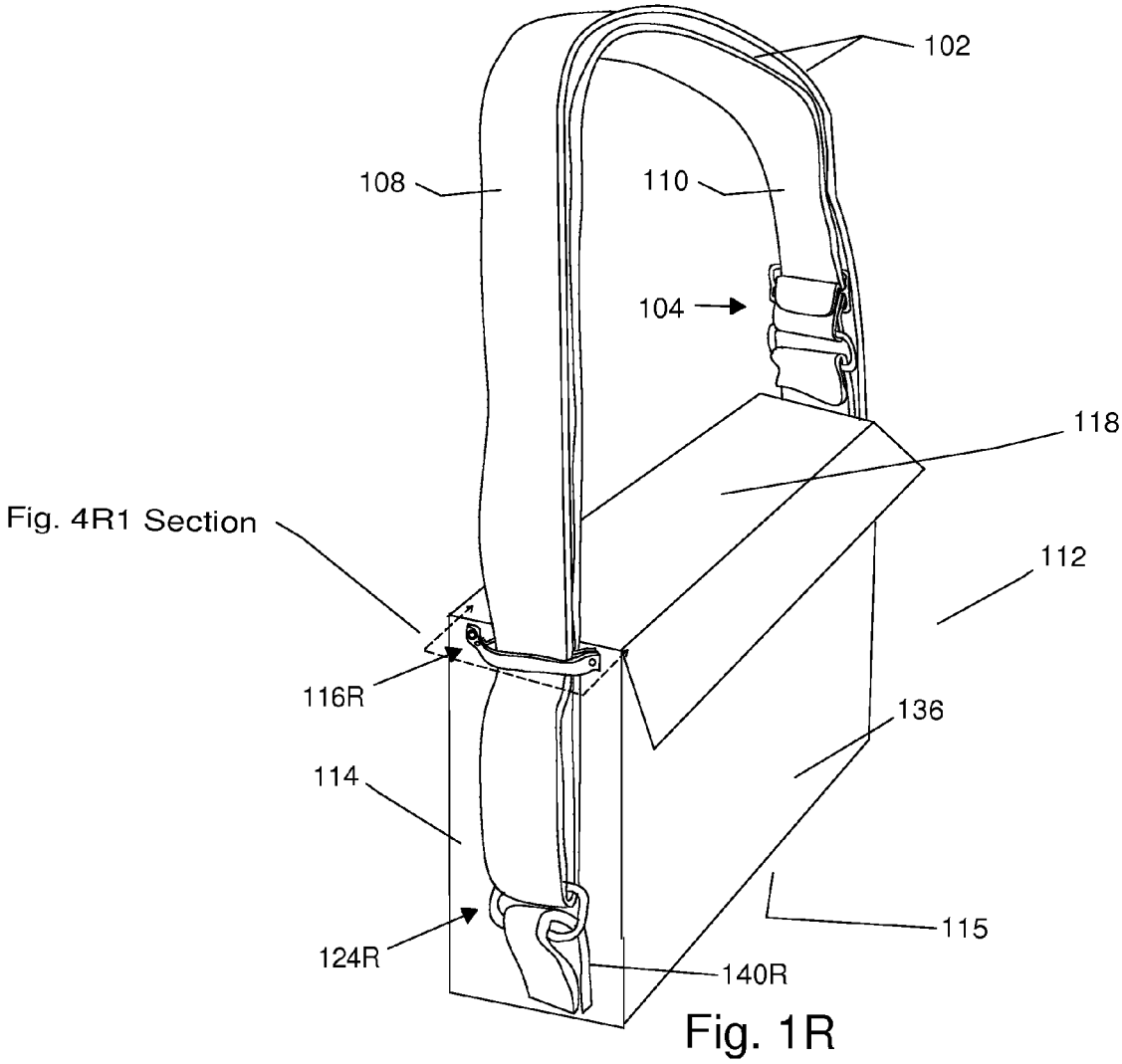
FIGS. 1R and 1L show right side/front and left side/front perspective views of the embodiment in the single-strap mode.
Figure 1L:
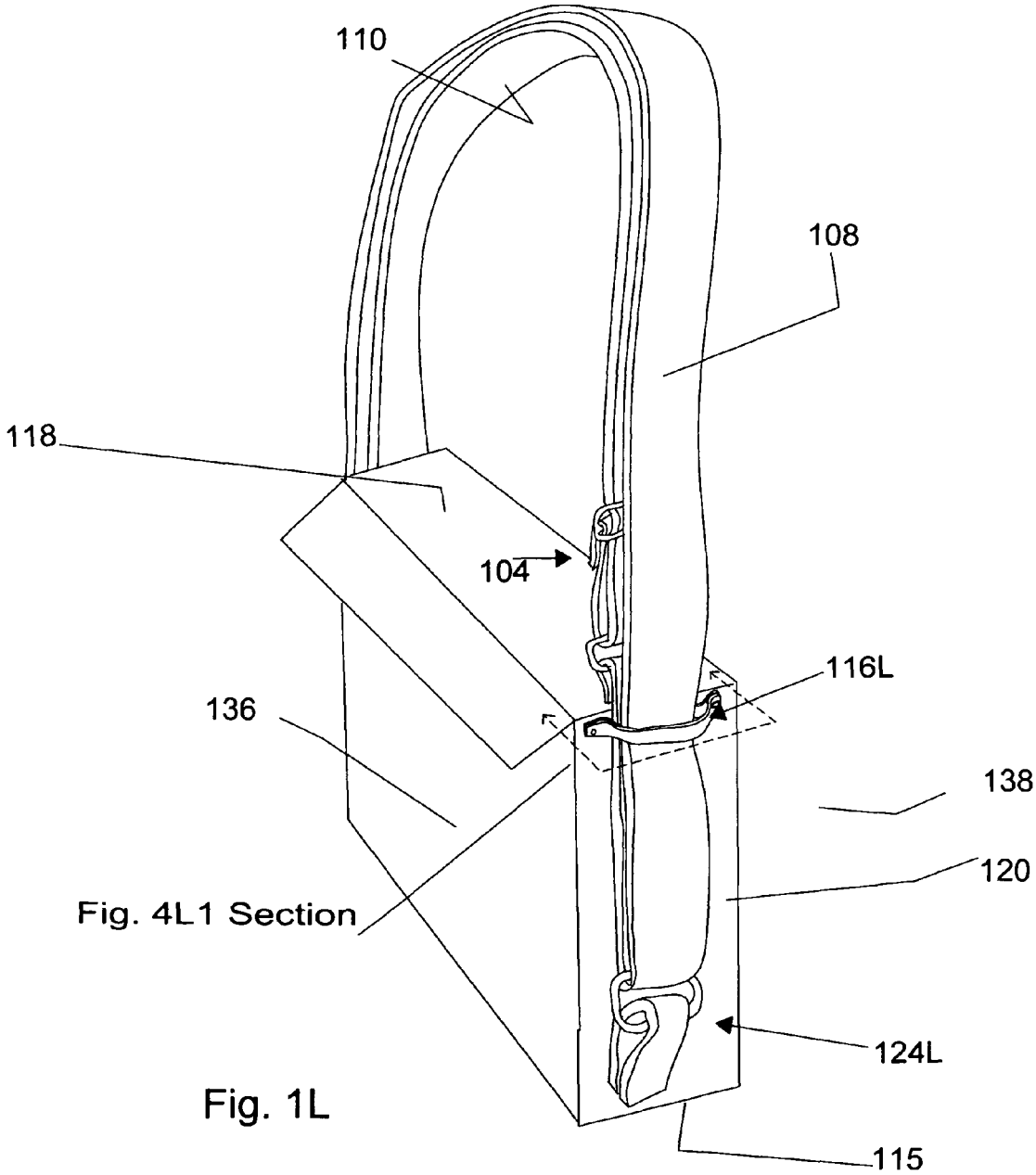

FIGS. 1R1 and 1L1 shows the right and left side constraining members.

Figure 2R:
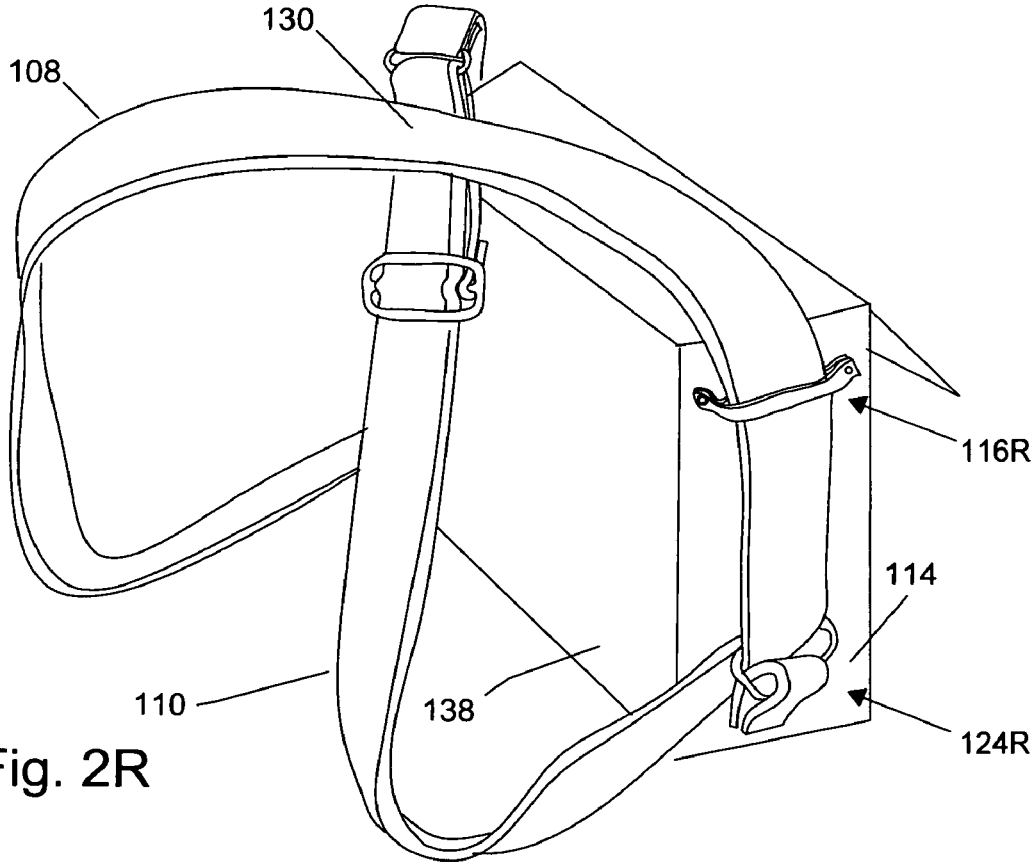
Figure 2L:
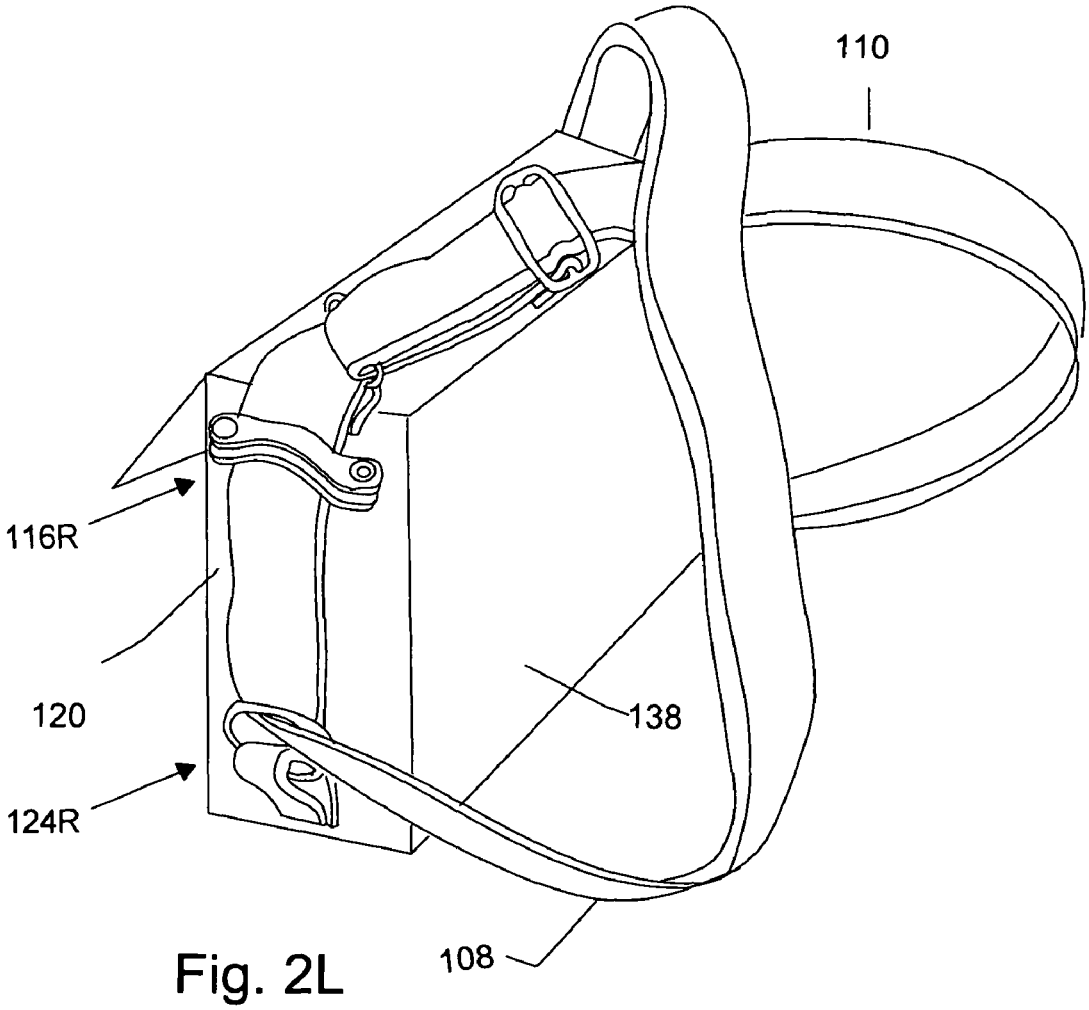

FIGS. 2R and 2L show right side/front and left side/back perspective views in the backpack mode.

FIG. 3R1 shows the embodiment in the dual-strap mode.

FIG. 3R2 shows the embodiment in the over-the-head mode.

FIGS. 4R1 and 4L1 show two cross-section views of the right side and the left side releasable constraining members of the bag with the strap configured in the single-strap mode.

FIGS. 4R2 and 4L2 show two cross-section views of the of the right side and the left side releasable constraining members of the bag with the strap configured as it is being converted from a single-strap mode to the backpack.

FIGS. 4R3 and 4L3 show two cross-section views of the right side and the left side of the bag with the strap configured in the backpack mode.

FIGS. 4R11 and 4L11 show cross-section views of those components of the composite members that constrain and release the two strap segments.

FIGS. 4R12 and 4L12 show breakout cross-section views of those components of the composite members that constrain the two strap segments.

FIGS. 5R1 and 5L1 show two perspective views of the right side and the left side of the bag with the strap configured as a single-strap mode.

FIGS. 5R2 and 5L2 show two perspective views of the right side and the left side composite members with the strap configured as it is in the process of transitioning it from a single-strap mode to the backpack mode.

FIGS. 5R3 and 5L3 show two perspective views of the right side and the left side composite members with the strap configured in the backpack mode.

FIGS. 6*a* through 6*e* show the bag and the sequence of views as the strap apparatus transitions from the single-strap mode to the backpack mode.

FIGURES FOR EMBODIMENT TWO

FIGS. 7R1 and 7L1 show two cross-section views of the composite members for the right side and the left side respectively when in the single-strap mode.

FIGS. 7R2 and 7L2 show two cross-section views of the composite members for the right side and the left side respectively when as the bag transitions from the single-strap mode to the backpack mode.

FIGS. 8R1 and 8L1 show two perspective views of the composite members for the right side and the left side respectively when in the single-strap mode.

FIGS. 8R2 and 8L2 show two perspective views of the composite members for the right side and the left side respectively when the bag is transitioning from the single-strap mode to the backpack mode.

FIGURES FOR EMBODIMENT THREE

FIGS. 9R1 and 9L1 show two perspective views of the composite members for the left side and the right side respectively when the bag is in the single-strap mode.

FIGS. 9R2 and 9L2 show two perspective views of the composite members for the left side and the right side respectively when the bag transitions from the single-strap mode to the backpack mode.

FIGS. 10R1 and 10R2 show cross-section views of the release mechanism when the right side composite member is in the single-strap mode and when it transitions to the backpack mode.

FIG. 11 gives a detail of the pin and slide.

FIGS. 12R1 and 12L1 give perspective views of the composite members for the right side and the left side respectively when the bag is in the single-strap mode.

FIGS. 12R2 and 12L2 give perspective views of the composite members for the right side and the left side respectively as the bag is transitions to the backpack mode.

FIGURES FOR EMBODIMENT FOUR

Figure 13L:
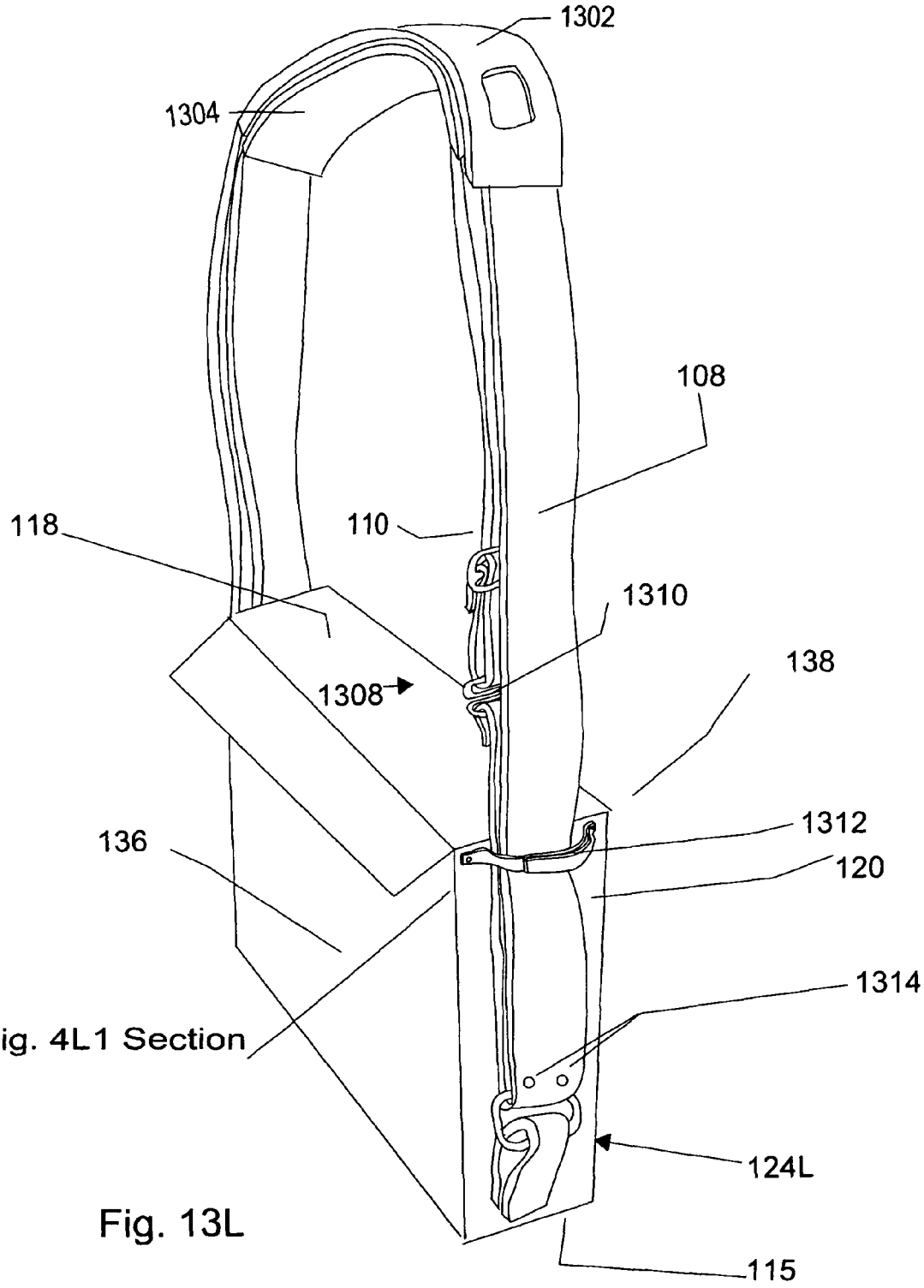
Figure 13R:
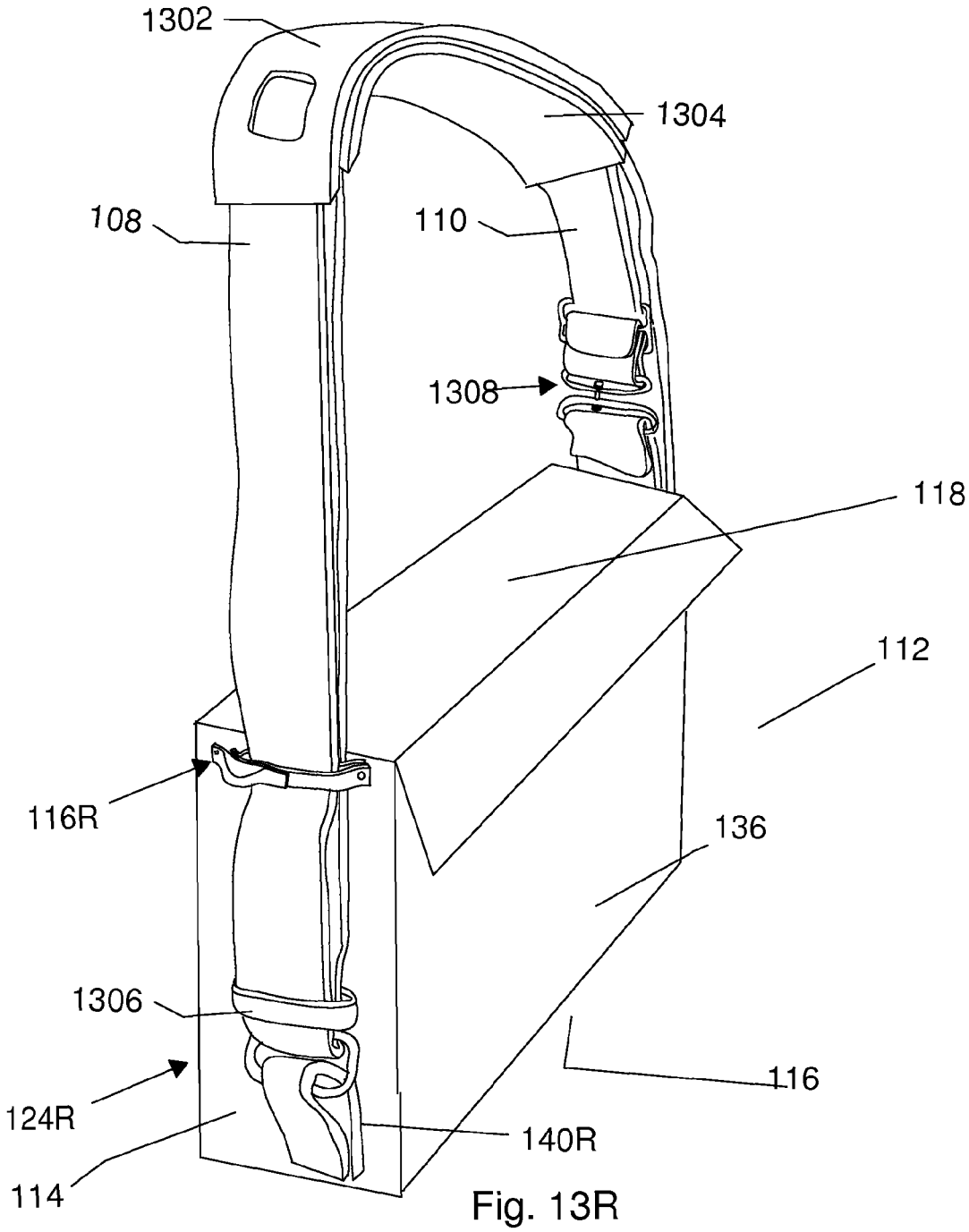

FIGS. 13L and 13R give two perspective views of the bag when in the single-strap mode.

Figure 14R:
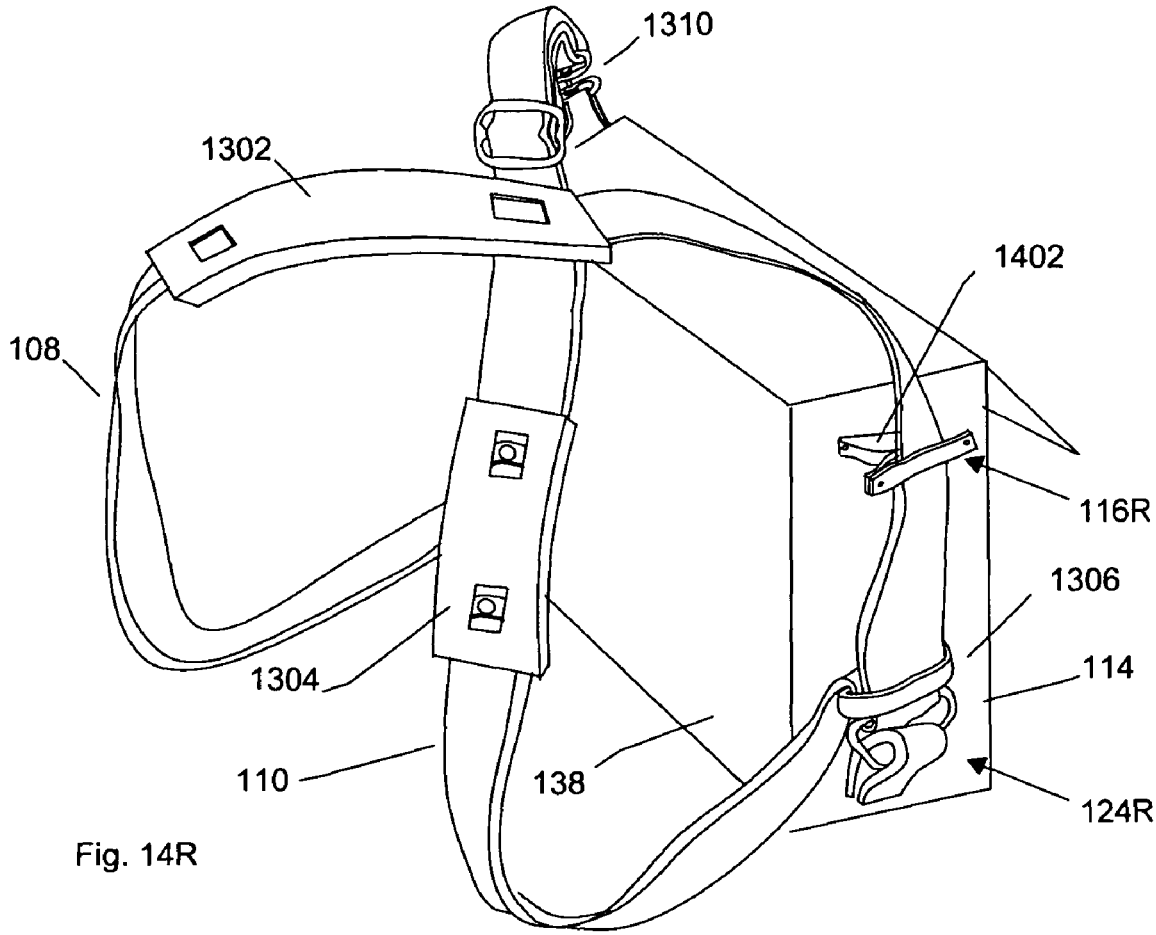
Figure 14L:
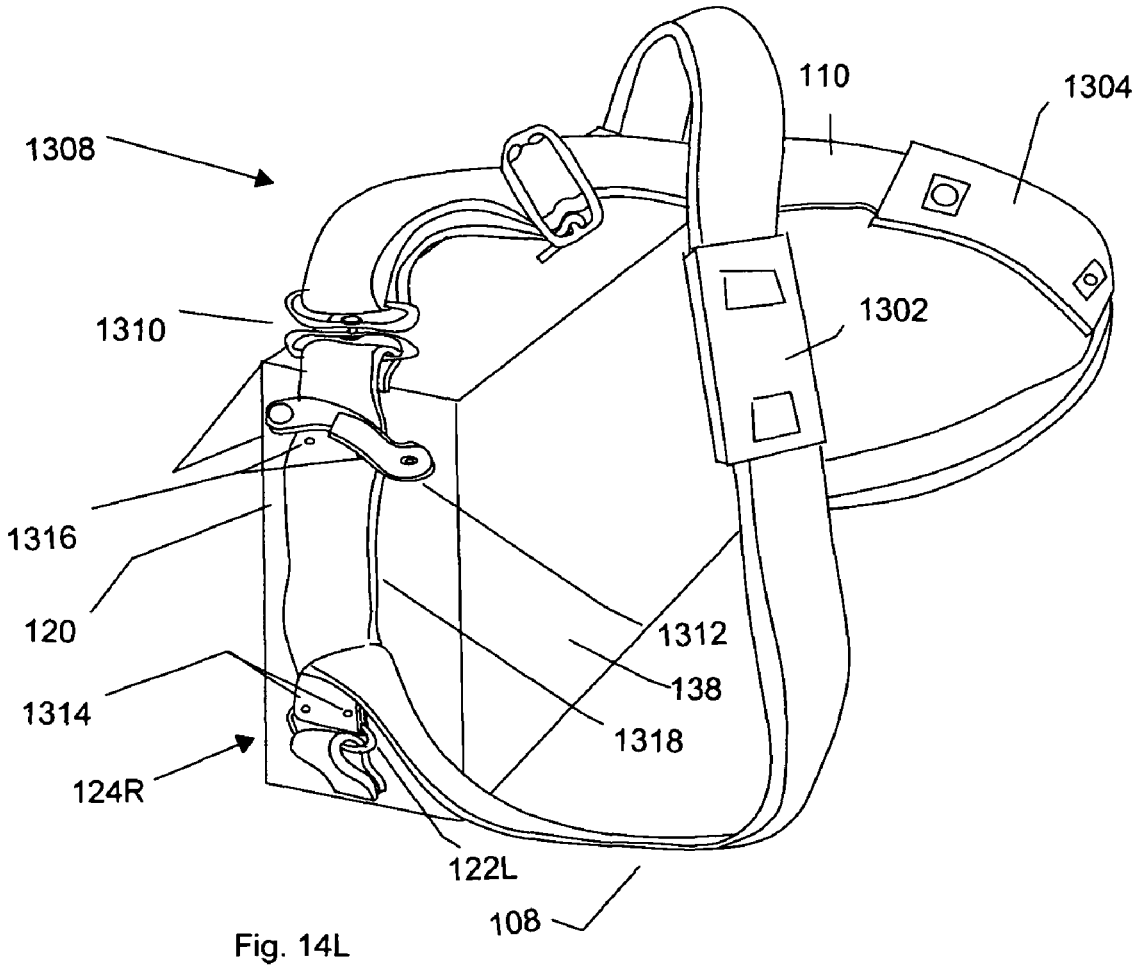

FIGS. 14R and 14L give two perspective views of the bag when in the backpack mode.

FIGS. 15L1 and 15L2 show two views of the strap adjustment mechanism with the double swivel strap rotational mechanism used on the inside strap on the left side.

FIGS. 15L3 and 15L4 show the strap adjustment means with an alternate design double swivel strap rotational mechanism.

FIGS. 15R1 and 15R2 show cross-sectional views of a design for the strap rotational mechanism on the right side when in the single-strap mode and the backpack mode respectively.

FIG. 15R3 shows a perspective view of the strap adjustment rotational mechanism on the right side when the bag is in the backpack mode.

FIGS. 15L5*a* through 15L5*f* show various views second alternate design for strap rotational mechanism.

FIG. 16*a*1 and 16*a*2 show perspective views of the stabilizer sleeve and the stabilizer sleeve installed respectively.

FIGS. 16*b*1 and 16*b*2 show a perspective view and a cross section view of an alternate design of a stabilizer sleeve that includes a thumbscrew.

FIG. 16*b*3 shows a perspective view of the stabilizer sleeve with thumbscrew installed.

Figure 17O:
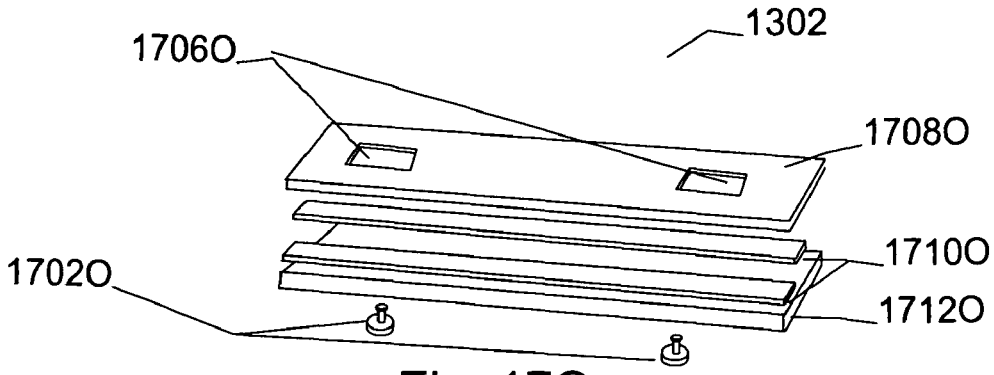
Figure 17I:
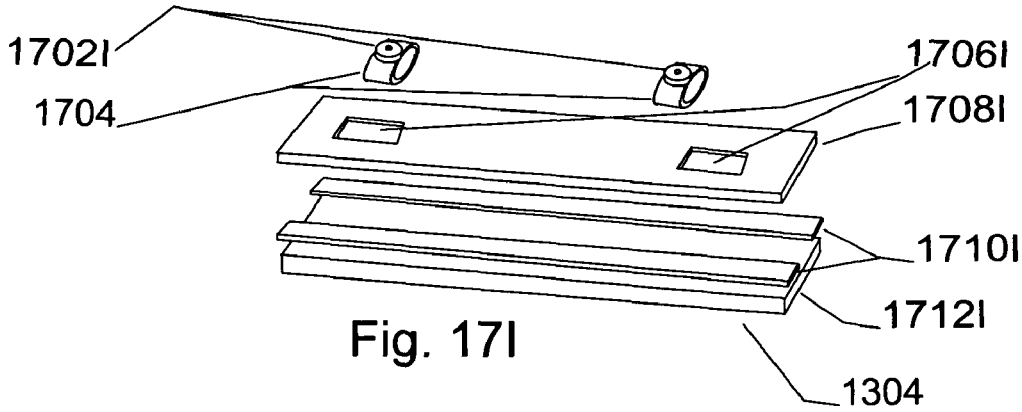

FIGS. 17O and 17I give perspective blowup views of the outside and inside shoulder pads.

Figure 17A:
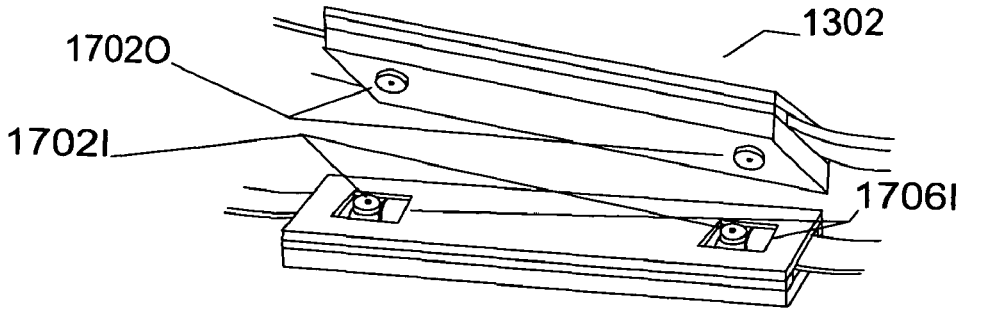

FIG. 17*a* show both outside and inside shoulder pads as they are about to be mated for the single-strap mode.

Figure 17B:
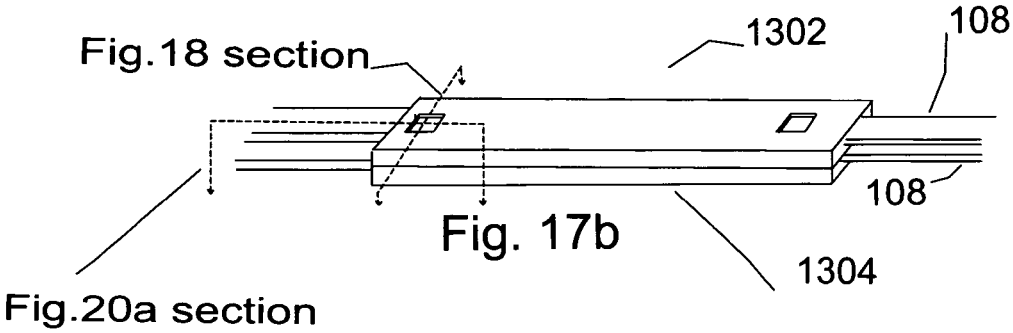
Figure 17C:
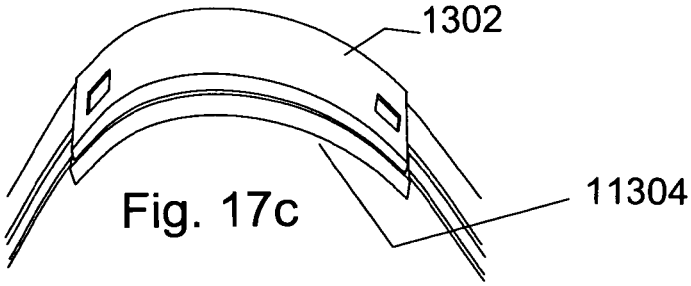

FIGS. 17*b* and 17*c* give two perspective views of the shoulder straps with the strap segments installed when the pads are straight and when they are curved respectively.

Figure 18:
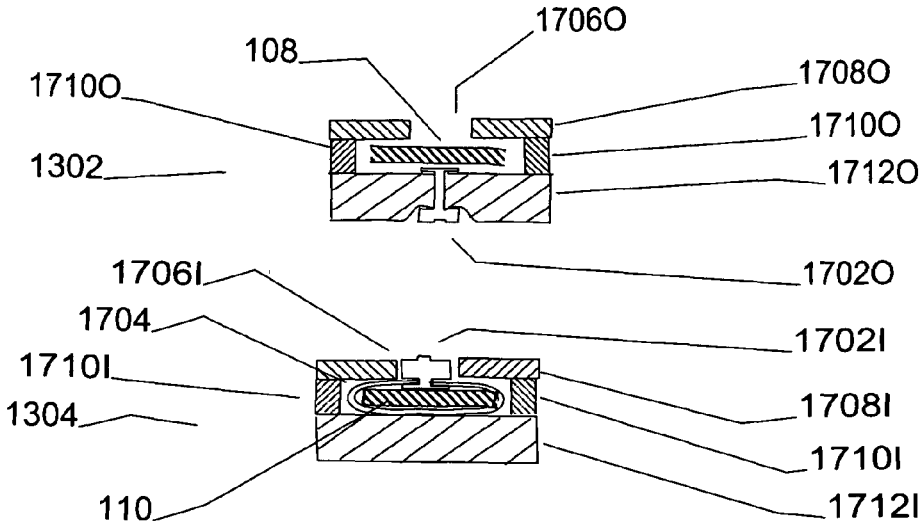

FIG. 18 gives a cross-section view of the shoulder pad construction.

Figure 19:
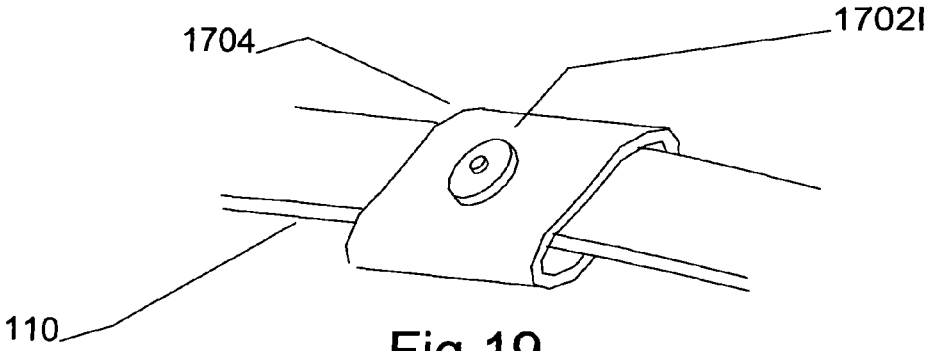

FIG. 19 gives a perspective view of the male magnetic snap components mounted on the sleeve and installed on a strap segment.

Figure 20A:
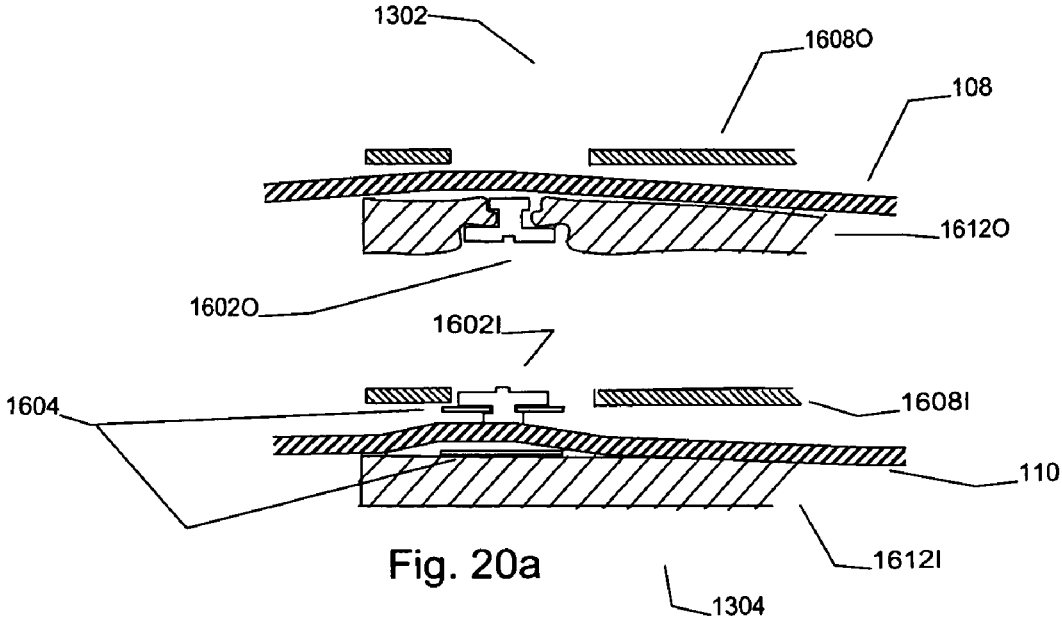
Figure 20B:
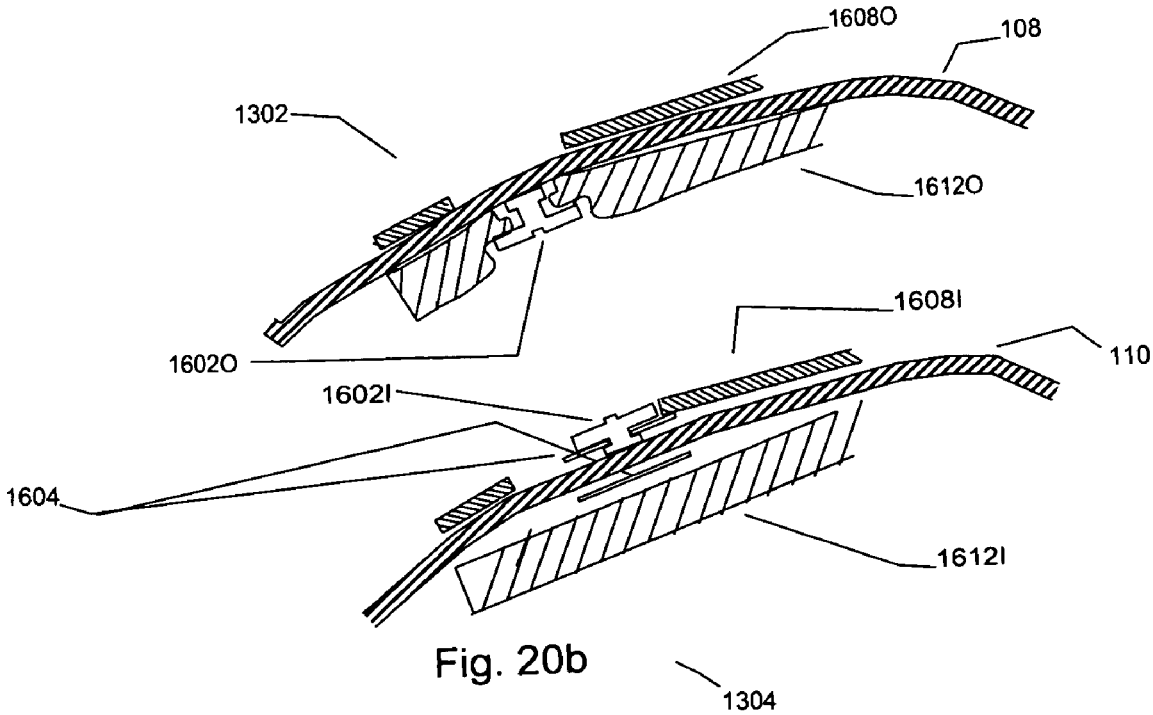

FIGS. 20*a* and 20*b* give cross-section views of the position of the magnetic snaps on the shoulder pads in the single-strap mode when the pads are straight and when they are curved respectively.

Figure 21A:
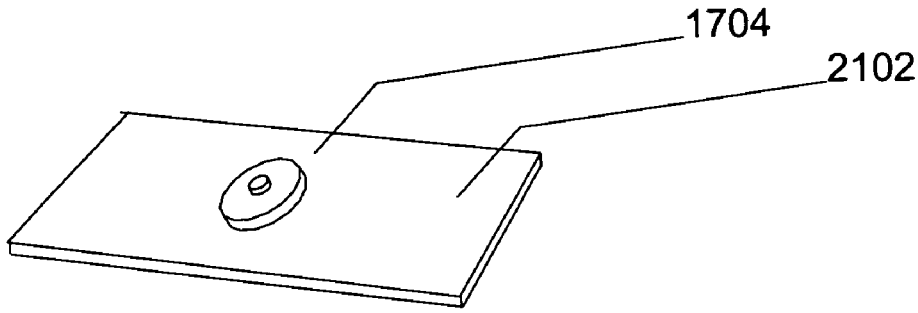

FIG. 21*a* and 2*b* give a perspective view and cross-section view respectively for an alternate design that replaces the male magnetic snap and sleeve.

FIGS. 22*a* through 22*e* show the bag as it transitions from the single-strap mode to the backpack mode.

Figure 23:
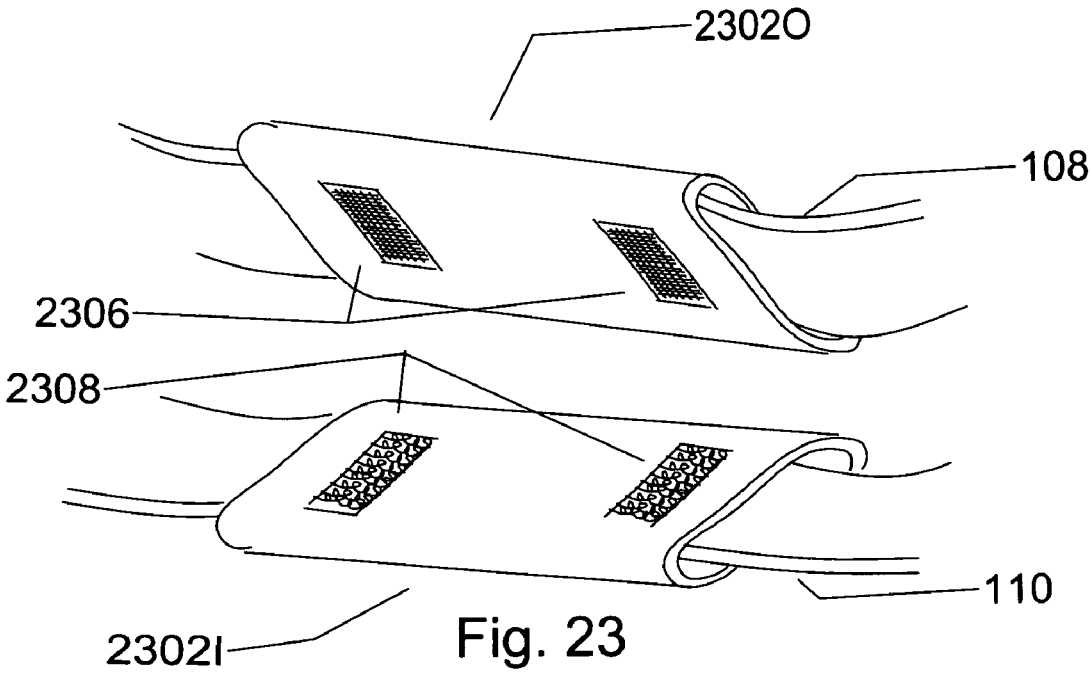

FIG. 23 shows an alternate design of the shoulder pads for the fifth embodiment.

FIGURES FOR EMBODIMENT SIX

Figure 24R:
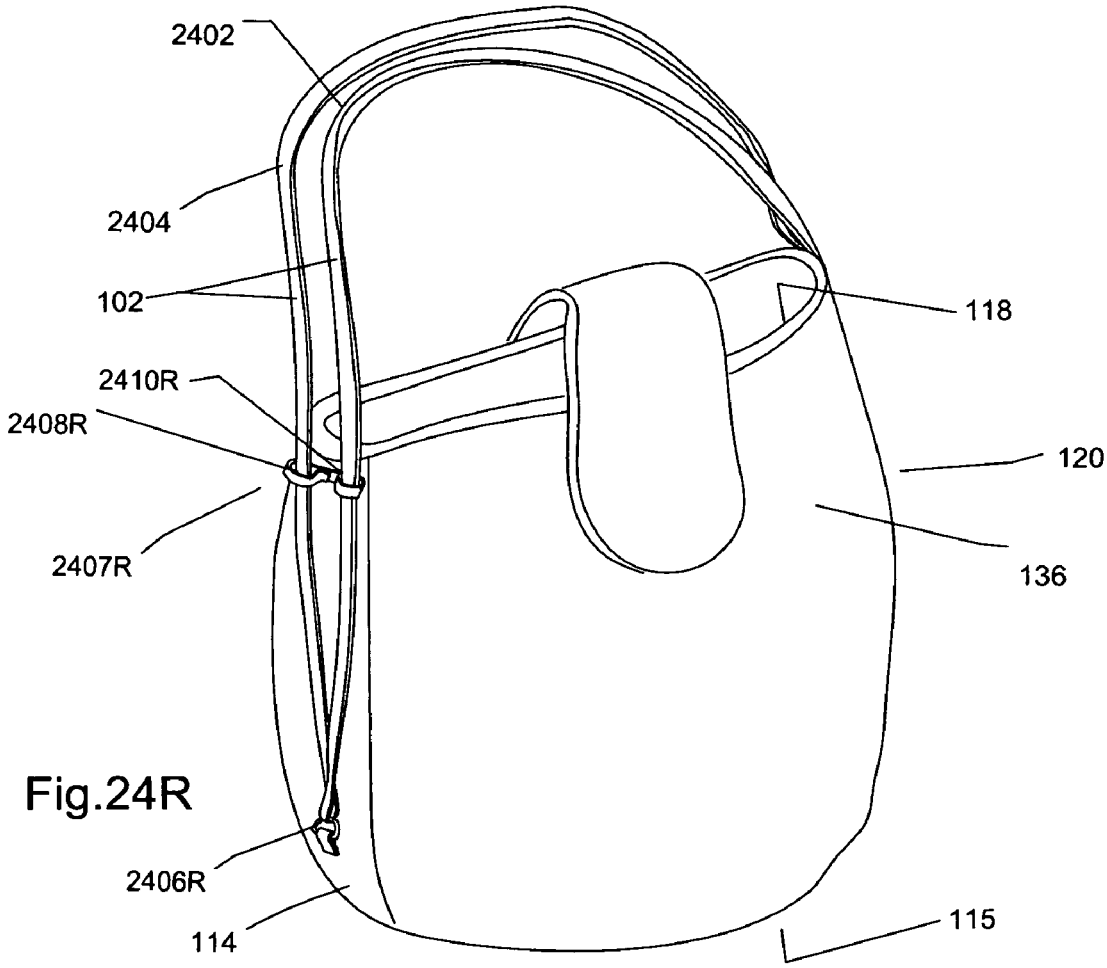

FIG. 24R shows a view from the front/right side perspective when the bag is in the single-strap mode.

Figure 24L:
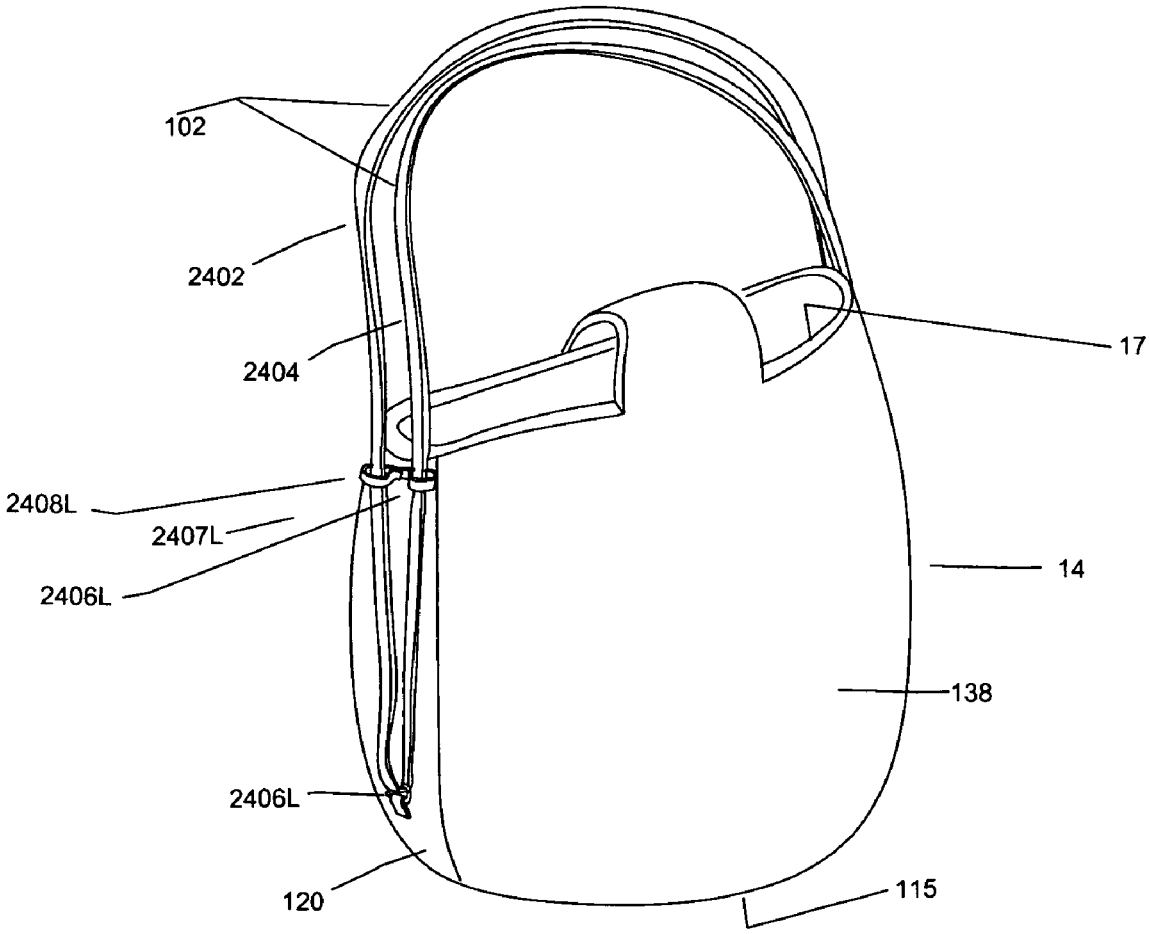

FIG. 24L shows a view from the back/left side perspective when the bag is in the single-strap mode.

Figure 25:
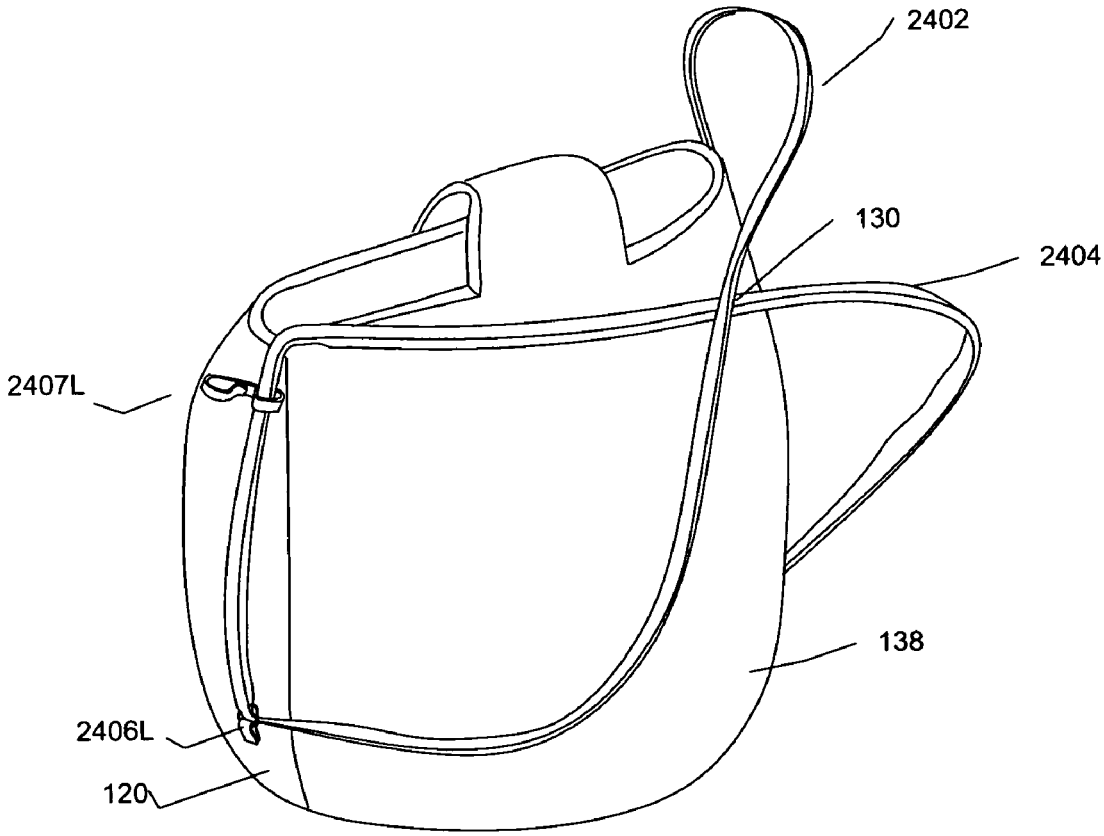

FIG. 25 shows a view from the back/left side perspective when the bag is in the backpack mode.

Figure 26B:
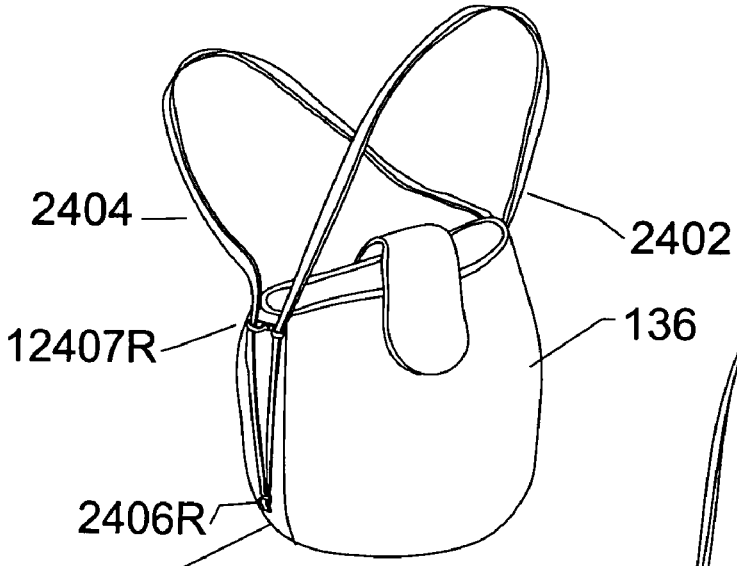
Figure 26A:
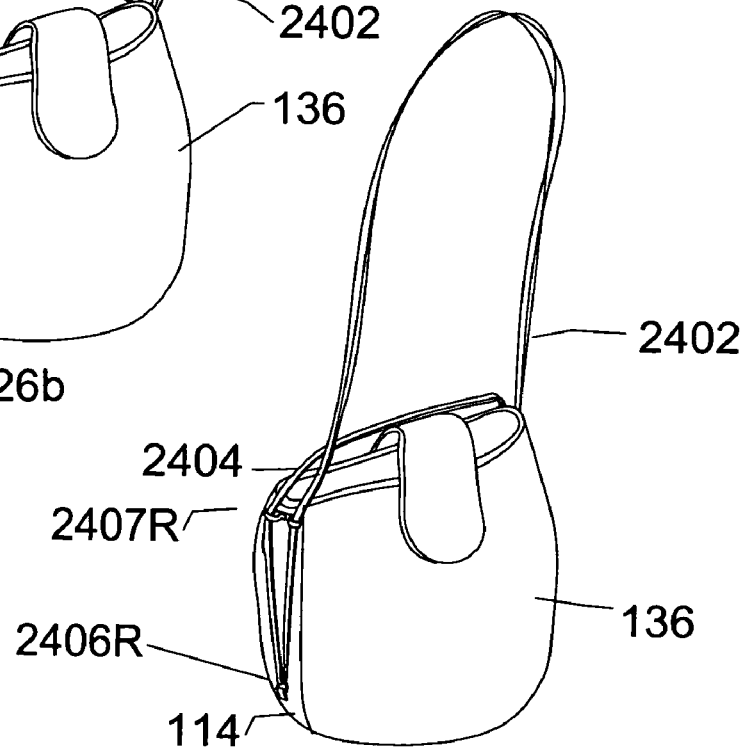

FIG. 26*a* shows a view of the sixth embodiment from the back/left side perspective when the bag is in the over-the-head mode.

FIG. 26*b* shows a view from the back/left side perspective when the bag is in the dual-strap mode.

FIG. 27R shows a detail view of the releasable composite member.

FIGS. 27R1 and 27L1 show detail views of the releasable constraining member for the right side and the left side respectively when the bag is in the single-strap mode.

FIG. 27R2 and 27L2 show detail views of the releasable constraining member for the right side and the left side respectively when the bag is in transition from the single-strap to the backpack mode.

FIGURES FOR EMBODIMENT SEVEN

Figure 28R:
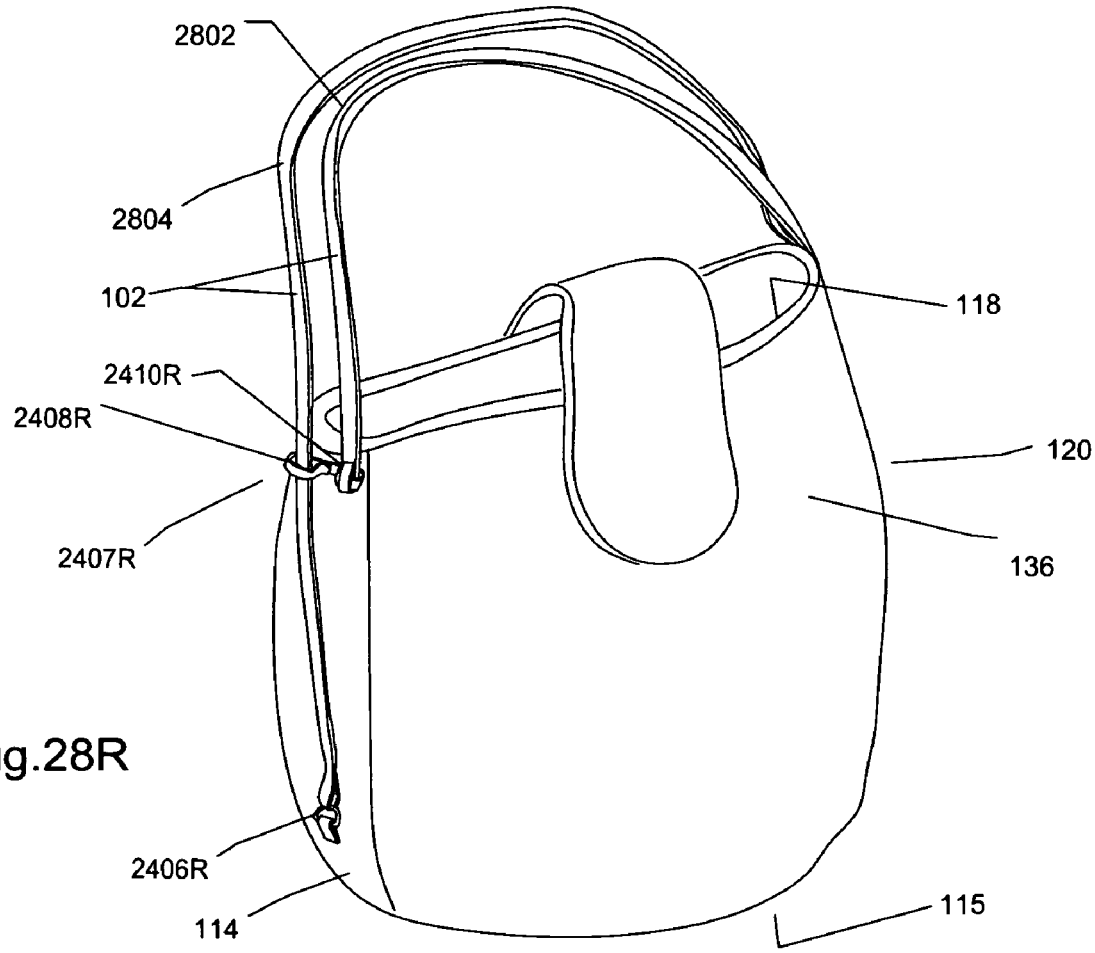
Figure 28L:
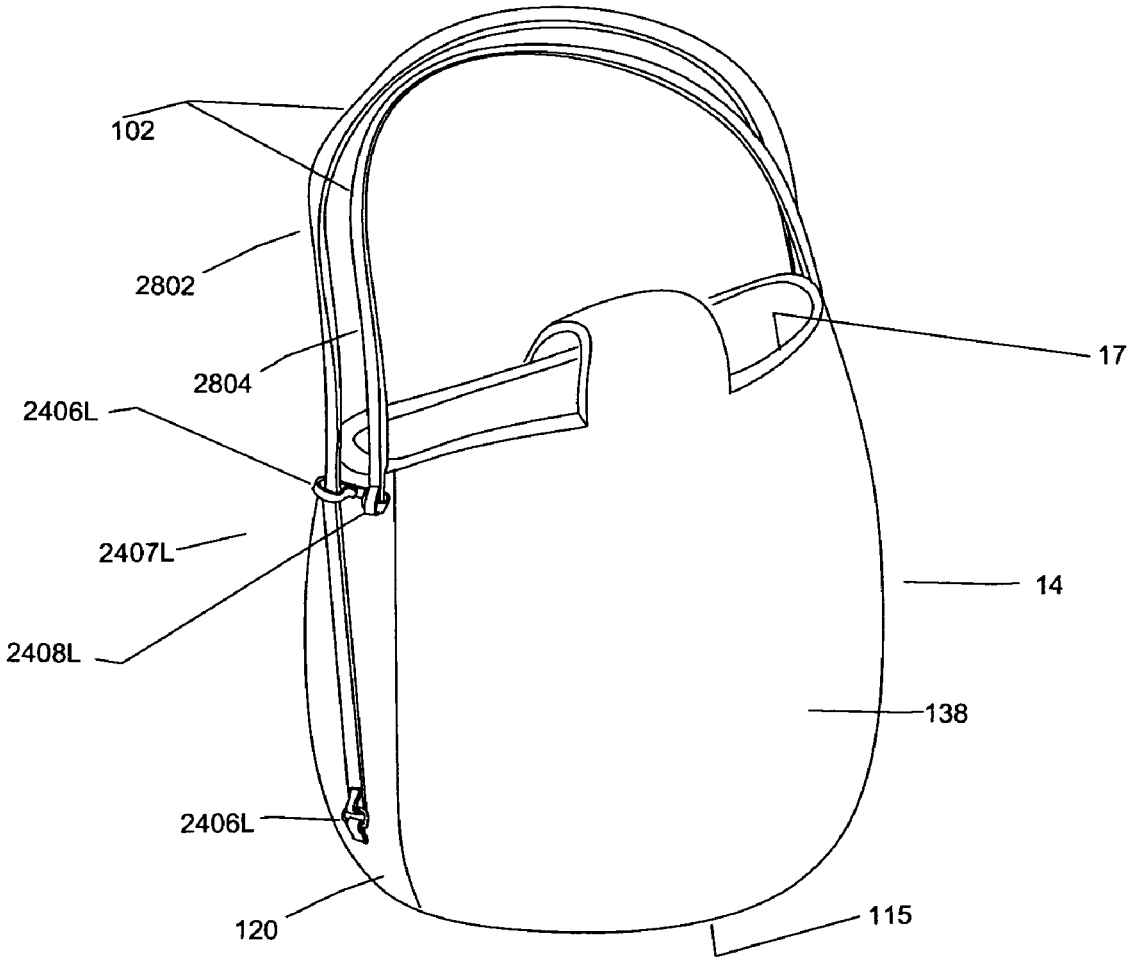

FIGS. 28R and 28L show right/front and left/back perspective views when the bag is in the single-strap mode.

Figure 29:
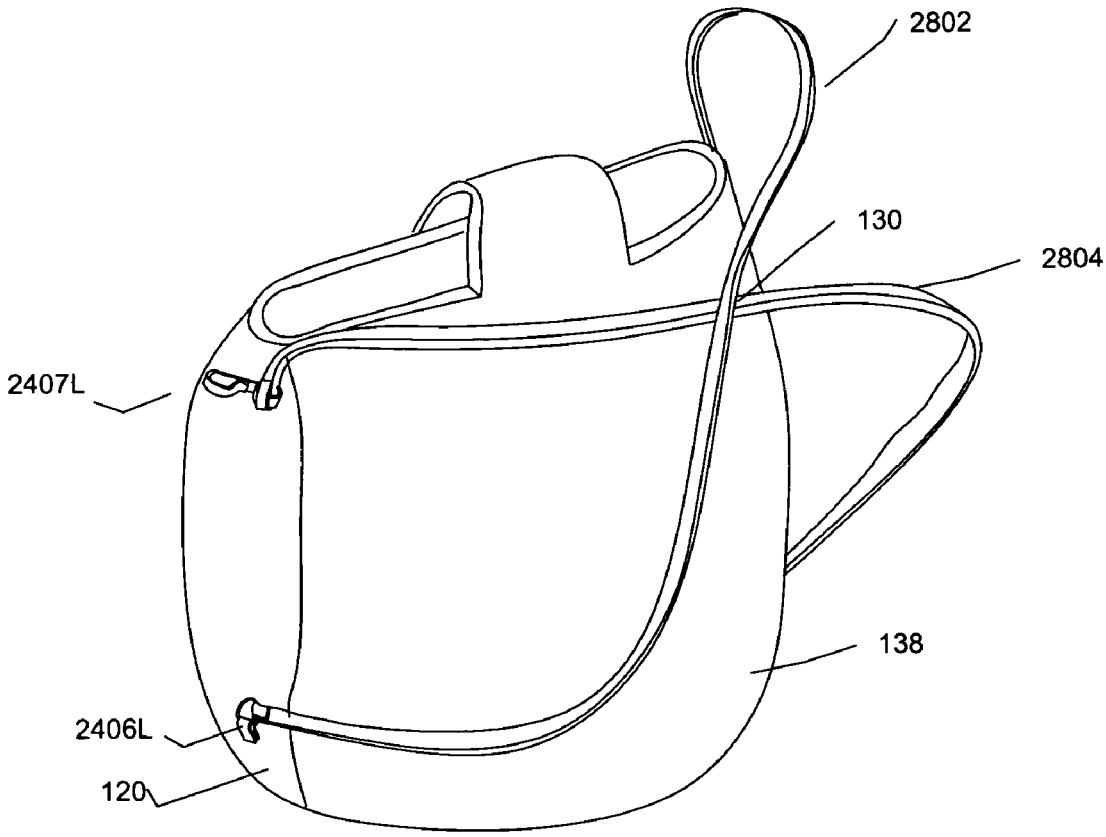
Figure 30A:
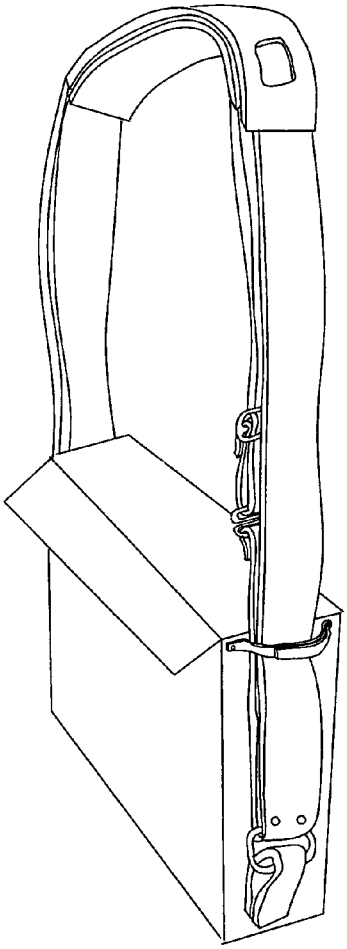
Figure 30C:
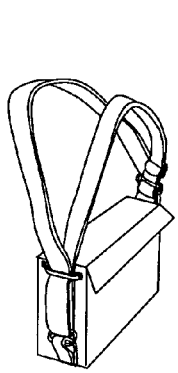
Figure 30D:
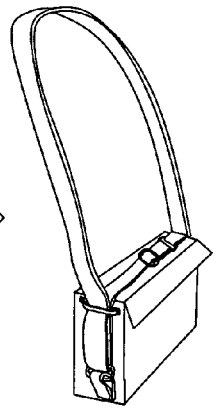
Figure 30B:
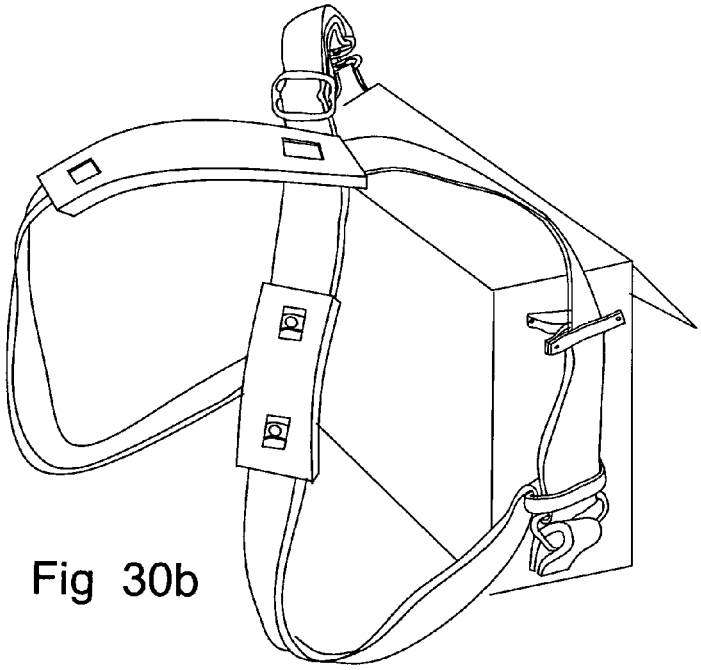

FIG. 29 shows a back/left side perspective when the bag is in the backpack mode.

FIG. 30 shows the four modes of the invention.

REFERENCE NUMERALS

102 strap
104 strap length adjustment mechanism (strap adjusting means)
106 closed loop belt (single strap)
108 outside strap segment
110 inside strap segment
112 carrying bag
114 right side of bag
115 bottom of bag
116R right side composite member
116L left side composite member
118 top of bag
120 left side of bag
122R right side single loop (single loop)
122L left side single loop
124R right side strap constraining member (first constraining means)
124L left side strap constraining member (second constraining means)
126R right side releasable constraining component (first releasable constraining means)
126L left side releasable constraining component (second releasable constraining means)
128R right side constraining component (third constraining means)
128L left side constraining component (fourth constraining means)
130 strap crossing location at back
132 double loop
134 single loop
136 front of the bag
138 back of the bag
140R component for attaching the strap to the right side (first attaching means)
140L component for attaching the strap to the left side (second attaching means)
402 first semi-rigid member on right side
404 second semi-rigid member on right side
406 fastener (third fastening means)
408 detachable connector on right side (first detachable connector means)
408*a* first component of detachable connector on right side
408*b* second component of detachable connector on right side
412 third semi-rigid member located on left side
414 fastener
418 fourth semi-rigid member located on left side
420 detachable connector on left side
420*a* first component of detachable connector on left side
420*b* second component of detachable connector on left side
602 right hand
604 left hand
610 location approximately six inches more or less to left position of hand on top of inside strap segment of strap
702 first semi-rigid member on right side for embodiment two
704 second semi-rigid member on right side
705 fastener
706 third semi-rigid member on right side
708 fastener
710 first semi-rigid member on left side
712 second semi-rigid member on left side
714 third semi-rigid member on left side
716 fastener
902 inside component of right side composite member for embodiment three
904 inside component of left side composite member
906 outside component of right side composite member
908 outside component of left side composite member
910 hinge on right side composite member
912 slide
914 slide frame
916 slotted pin attached to inside component of composite member
918 circular holes on right side (Not Used)
919B holes on left side
919T holes on left side
920 rectangular slot on outside component on right side
922 rectangular cavity on outside component on left side
924 rectangular slot on inside component on right side
926 rectangular cavity on inside component on left side
1002 spring
1004 rectangular opening on slide
1006 protuberance on slide
1007 channel
1008 notch on pin

1302O outside shoulder pad for embodiment four (first shoulder pad)
1302I inside shoulder pad (second shoulder pad)
1306 stabilizing sleeve (stabilizing means)
1308 strap adjustment mechanism and double swivel
1310 double swivel (strap rotational means)
1312 releasable constraining member on left side
1314 rivets
1316 rivets
1318 strap subsegment handle on left side (lifting means)
1402 third semi-rigid member on right side (strap rotational means)
1504 double swivel top loop
1506 double swivel bottom loop
1508 double swivel pin
1510 double swivel bar
1512 bulge on third semi-rigid member on right side (strap rotational means)
1514 swivel
1516T top swivel component
1518T top swivel slide subcomponent
1518B bottom swivel slide subcomponent
1520T top swivel foot subcomponent
1520B bottom swivel foot subcomponent
1522T top swivel slot
1522B bottom swivel slot
1524 hinge
1524T hinge top component
1524B hinge bottom component
1526 spring
1528 rotating stop
1530 hinge pin
1602 stabilizing sleeve with threaded hole for thumbscrew
1604 thumbscrew
1606 thumbscrew knob
1608 thumbscrew threaded shaft
1610 thumbscrew backplate
1612 threaded circular hole on stabilizing sleeve
1702I male component of magnetic snap
1702O female component of magnetic snap
1704 sleeve
1706O rectangular openings on top non-rigid rectangular element of outside shoulder pad
1706I rectangular openings on top non-rigid rectangular element of inside shoulder pad
1708I top non-rigid rectangular element of inside shoulder pad
1708O top non-rigid rectangular element of outside shoulder pad
1710I side non-rigid rectangular elements of inside shoulder pad
1710O side non-rigid rectangular elements of outside shoulder pad
1712I bottom non-rigid rectangular element of inside shoulder pad
1712O bottom non-rigid rectangular element of outside shoulder pad
2102 thin rigid element
2302O outside shoulder pad from embodiment five
2302I inside shoulder pad
2306 loop component of a hook and loop pair
2308 hook component of a hook and loop pair
2402 front strap segment for embodiment six (first strap segment)
2404 back strap segment six (second strap segment)
2406R right side constraining member (first constraining member)
2406L left side constraining member (second constraining member)
2407R right side composite member
2407L left side composite member
2408R releasable constraining component on right side (first releasable constraining means)
2408L releasable constraining component on left side (second releasable constraining means)
2410R constraining component on right side (third constraining means)
2410L constraining component left side (fourth constraining means)
2412R fastener
2412L fastener
2802 front strap segment for embodiment seven
2804 back strap segment

DETAILED DESCRIPTION

Embodiment One

The following description is of the first embodiment 102 of the invention.

FIGS. 1R, 2R, 3R1 and 3R2 show perspective views of the first embodiment in the four modes: single-strap, backpack, dual strap and long strap. The remaining figures through FIG. 6*e* show alternate views, design details and usage of this embodiment.

We now refer to FIGS. 1R, 1L, 1R1, 1L1, 1S, and 1A. Embodiment one consists of a strap 102 that together with the strap length adjustment mechanism 104 form a single belt doubled in the shape of a closed loop 106, with an outside strap segment 108 and an inside strap segment 110. The strap 102 is attached to the bag 112, which has a right side 114, a left side 120, a bottom 115 and a top 118. When the strap 102 attached to the carrying bag 112,= is configured in the single-strap mode as show in FIGS. 1R and 1L, the outside strap segment 108 and inside strap segment 110 are doubled over so that the outside segment lies on top of and in contact with the inside strap segment. This appears to a casual observer as a bag with a single shoulder strap. In this mode, outside strap segment 108 is on the outside and the inside strap segment 110 is on the inside of the doubled strap. This embodiment contains a right side 114 composite member 116R, a left side 120 composite member 116L, and right side and left side constraining members 124R and 124L respectively.

The composite member 116R, located on the right side 114, serves a double function; it releasably constrains the inside strap segment 110 and constrains the outside strap segment 108. The left side 120 composite member 116L also serves a double function; it releasably constrains the outside strap segment 108 and constrains the inside strap segment 110.

This embodiment includes constraining members 124R and 124L on the right side and the left side respectively, that attach the strap to the bag on the left and right sides respectively, yet allow the straps to slide through them.

FIG. 1R1 shows the constraining member 116R for the right side 114. It consists of a single loop 122R, and a component 140R for attaching the loop 122R to the bag on the right side 114 toward the bottom 115. FIG. 1L1 shows the constraining member 116L for the left side 120. It consists of a single loop 122L, and a component 140L for attaching the loop 122L to the bag on the left side 120 toward the bottom. The two components 140L and 140R are small strap segments that pass through the loops 122R and 122L respectively. The doubled strap 102 is attached to the single loops 122R and 122L by passing through them. The two strap segments 108 and 110 each extend from the loop 122R on the right side 114 to the other loop 122L on the left side 120 and consists of equal lengths in the single-strap mode.

FIG. 1A shows the strap length adjustment mechanism 104. The adjustment mechanism 104 consists of a double loop 132 and a single loop 134. The adjustment mechanism is implemented in the conventional manner for adjustment mechanisms for carrying bag straps.

FIG. 2R shows a first perspective view of the bag in its second mode; the backpack mode. In this figure the bag is viewed from the right side 114 and the back 138. In this mode the outside strap segment 108 is constrained by the composite member 116R on the right side. The inside strap segment 110 is no longer constrained on the right side. It is positioned away from the back 138. When the user wears the bag in the backpack mode, the two strap segment cross at location 130 at the back of the user.

FIG. 2L shows a second perspective view of the bag in the backpack mode, viewed from the left side 120 and the back 138. In this mode the inside strap segment 110 is constrained by the composite member 116L on the left side 120. The outside strap segment 108 on the left side 120 is no longer constrained. It is positioned away from the back 138.

FIG. 3R1 shows a perspective view of the bag in its third mode; the dual-strap mode. In this mode, the strap apparatus is constrained to the bag in the same manner as in the single-strap mode as shown in FIGS. 1R and 1L. In the dual-strap mode however, the portions of the inside strap segment 110 and outside strap segment 108 that are above bag 112 are separated. In this mode, there are two separate straps segments emanating from the bag; the outside strap segment 108 above the bag goes over one of the user's shoulders, and the inside strap segment 110 above the bag goes over the user's other shoulder. When worn in this mode, the bag remains at the user's side towards the back of the user; however, the bag's weight is distributed evenly over both shoulders rather than over just one shoulder as in the single-strap mode.

FIG. 3R2 shows the bag in its fourth mode, the over-the-head mode. In this mode, the strap apparatus is constrained to lie against the sides of the bag in the same manner as in the single-strap mode as shown in FIGS. 1R and 1L. In the over-the-head mode however, the portions of the inside strap segment 110 and the outside strap segment 108 that are above bag 112 have unequal lengths—with the outside strap segment 108 extended as much as possible and the inside strap segment 110 shortened to its minimum extent so it lays against the top of the bag.

FIGS. 4R1 and 4L1 show respective cross-section details of the right side composite member 116R and the left side component 116L when the bag is in the single-strap mode. FIGS. 4R2 and 4L2 show the details of the right side composite member 116R and the left side composite member 116L respectively when the bag is transitioning from the single-strap mode to the backpack mode. FIGS. 4R3 and 4L3 show the details of the right side composite member 116R and the left side composite member 116L respectively when the bag is in the backpack mode.

Referring now to FIG. 4R1, the right side composite member 116R is comprised of a first semi-rigid member 402 and a second semi-rigid member 404 that sandwich the outside strap segment 108 so it is constrained to stay against the right side but can slide up and down. The first and second semi-rigid members 402 and 404 respectively are joined together at both ends. One pair of ends is fastened to each other and also to the right side toward the front 136 and near the top with fastener 406. The other pair of ends is fastened together with one component 408*b* of a first detachable connector 408. The other component of the detachable connector 408*a* is attached to the right side. The fastener 406 and detachable connector 408 are positioned so that when the bag is in the single-strap mode the detachable connectors are attached, and the two strap segments 108 and 110 on the right side are held flat against the right side; the outside segment 108 lies directly over the inside segment 110 so they appear to a casual observer as a single strap.

The composite member on left side 16L is shown in FIG. 4L1 when the bag is in the single-strap mode. It has a different design than the composite member on the right side. It is constructed of two semi-rigid members 412 and 418. The third semi-rigid member 412, located on the left side, is fastened on one end to the left side 120 toward the front 136 with fastener 414. The other end is attached to the left side towards the top and the back with one component 420*a* of a detachable connector 420. The third semi rigid member 412 constrains the inside strap segment 110 to lie against the left side of the bag, but allows the strap segment to slide up and down. The fourth semi-rigid member 418, located on the left side, has one end fastened to the left side 120 toward the front 136 with the same fastener 414 that is used to attach the third semi-rigid member on the left side. Its other end is attached to the second component 420*b* of the detachable connector 420. When the bag is in the single-strap mode the outside strap segment 110 is sandwiched between the two semi-rigid connectors 412 and 418, and the releasable connector 420 is connected so that outside strap segment 110 on the left side is constrained to lie on top of the inside strap segment 108. When the bag is in the backpack mode, the outside strap segment 110 on the left side is not constrained.

FIG. 5R1 shows a perspective view of the composite member 116R for the right side/front and FIG. 5L1 shows a perspective view of the composite member 116L for the left side/front when the bag is in the single-strap mode. The composite members 116R and 116L are located on the right side and the left side respectively near the top of the bag. In this case the detachable connectors 408 and 420 are connected to the sides of the bag so that the releasable constraining members 116R and 16L constrain the strap segments 108 and 110 to lie against the sides of the bag.

FIGS. 4R2 and 4L2 show cross section views of the right side and left side as the bag transitions into the backpack mode. The detachable connectors 408 and 420 are released and the inside strap segment 110 on the right side and the outside strap segment 108 on the left side are free to move away from the bag.

FIG. 5R2 shows a perspective view of the strap composite member 116R for the right side 114 and FIG. 5L2 shows a perspective view of the composite member 116L for the left side 120 as the bag transitions between the single-strap mode and the backpack mode. In this case the detachable connectors 408 and 420 are detached and the strap segments 110 on the right side and 108 on the left side are free to move away from the bag and become configured for wearing as a backpack.

FIGS. 4R3 and 4L3 show the right side and left side when the bag is in the backpack mode. The detachable connectors 408 and 420 are connected but the inside strap segment 110 on the right side and the outside strap segment 108 on the left side are away from the bag.

FIG. 5R2 shows a perspective view of the composite member 116R for the right side 114 and FIG. 5L2 shows a perspective view of the composite member 116L for the left side 120 when the bag is in the backpack mode. In this case the detachable connectors 408 and 420 are connected and the strap segments 110 on the right side and 108 on the left side are away from the bag.

FIGS. 4R11, 4R12, 4L11 and 4R12 show breakouts of the composite members 116R and 116L into releasable constraining components 126R and 126L respectively, and constraining components 128R and 128L. The breakout shows how the composite members function; they have some elements in common. The releasable constraining components hold the strap segments against the sides of the bag when in the single-strap mode, but allow those strap segments to be released so they can transition to the backpack mode. The constraining components constrain the strap segments to lie against the sides of the bag, but allow them to slide within them up and down.

In this embodiment, the releasable constraining component and the constraining components are integrated into a single composite member on each side. This embodiment works best when the bag sides are rigid. For bags that have non-rigid sides, bag stiffeners will improve its use.

Operation

Figure 6A:
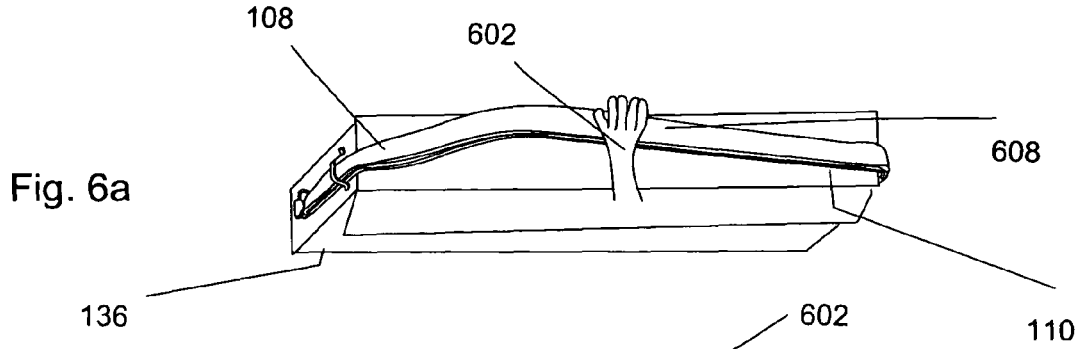
Figure 6B:
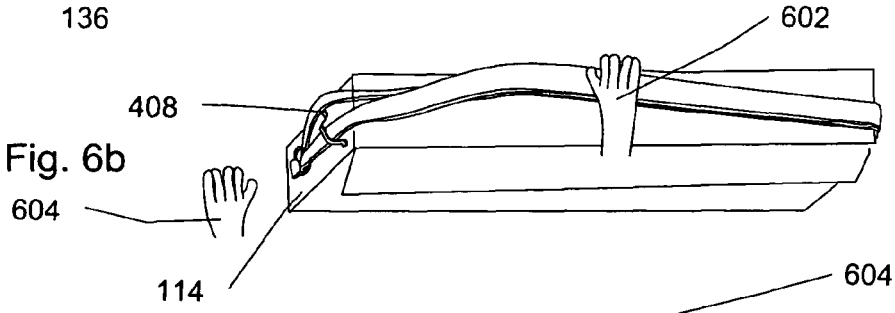
Figure 6C:
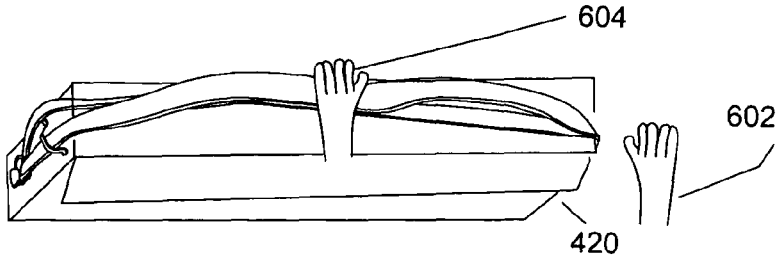
Figure 6D:
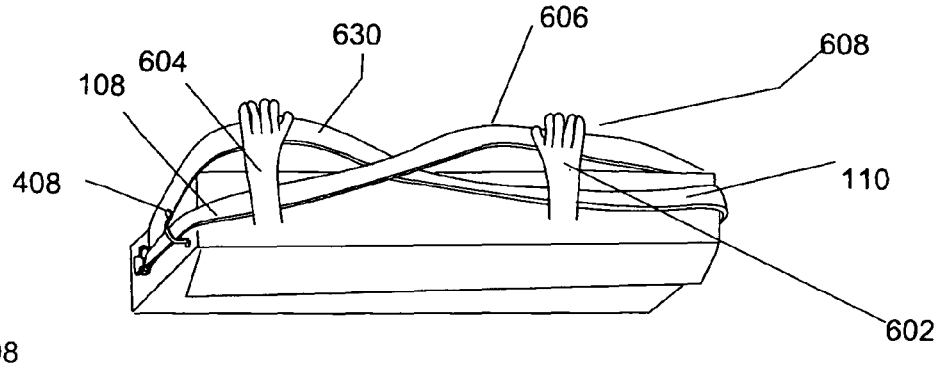
Figure 6E:
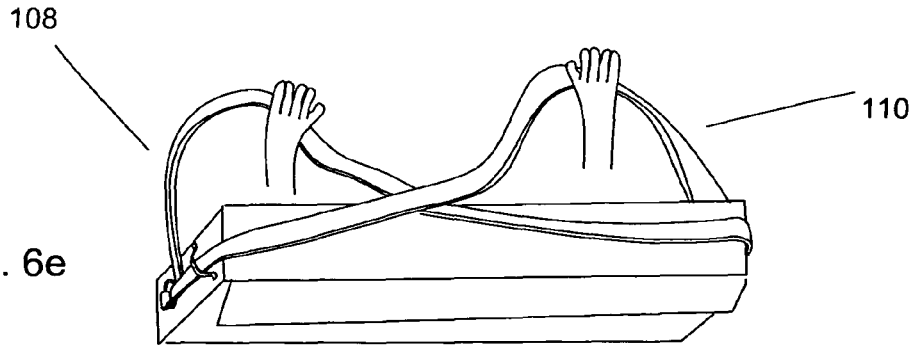

FIGS. 6*a* through 6*e* show the first embodiment as a user transitions the strap apparatus from the single-strap mode to the backpack mode. FIG. 6*a* shows the bag in the single-strap mode. To convert to the backpack mode, the user grabs both the outside strap segment 108 and the inside strap segment 110 with the right hand 602, and lifts the bag so that the bag hangs neatly with the bottom approximately parallel to the floor. The bag is positioned in front of the user and the front 136 facing the user.

Referring now to FIG. 6*b*, the user then detaches the detachable connector 408 on the right side 114 with the left hand 604, releases the inside strap segment 110 and then reattaches the detachable connector 408.

Referring now to FIG. 6*c*, the user then grabs the two strap segments at the top with the left hand 604, releases the detachable connector 420 on the left side with the right hand 602, an then reattaches the detachable connector 420. The detachable connector 420 is hidden in the figure.

Referring now to FIG. 6*d*, the user then grabs the outside strap segment 108 at its highest point with the right hand 602, and grabs the inside strap segment 110 at its highest point with the left hand 604. The user's hands are positioned above the strap segments with palms down.

Referring now to FIG. 6*e*, the user then lifts the two strap segments so the bag hangs so the bag's bottom is approximately parallel to the plane of floor. The strap then takes the shape as shown in FIG. 2R, so that the bag can be worn as a backpack. The user then puts the inside strap segment 110 over the right shoulder and the outside strap segment 108 over the left shoulder so the bag lies on the back of the user and the two strap segments cross at the back of the user.

To convert the bag from a backpack mode to a single-strap mode, the user reverses these steps. To convert the bag from the single-strap mode to a dual-strap mode, the user first puts on the bag in the single-strap mode. If the straps are on the user's right shoulder then the user grabs the outside strap with the left hand and moves the outside strap segment over the user's head to the left shoulder. If the straps are on the user's left shoulder then the user grabs the outside strap segment with the right hand and moves the outside strap over the user's head to the right shoulder.

This completes the description of the first embodiment of the invention.

Second Embodiment

The following is a description of the second embodiment of the invention. The only difference between the second embodiment and the first embodiment is that it has a different implementation of the right and left composite members 116R and 116L.

The composite member 116R on the right side is shown in FIG. 7R1 when the bag is in the single-strap mode. Referring to FIG. 7R1, the right side composite member 116R has a first semi-rigid member on the right side 702 and a second semi-rigid member on the right side 704 that sandwich the outside strap segment 108 so that the segment is constrained to stay against the right side but can slide up and down. The first semi-rigid member on the right side 702 is constructed from the hook component of a hook and loop pair, with the hook component facing away from the bag. The first and second semi-rigid members on the right side 702 and 704 respectively are joined together on both ends, with one pair of ends fastened to each other and also to the right side toward the front 136 and towards the top with fastener 406. The other pair of ends fastened together with a fastener 705. A third semi-rigid member on the right side 706 is attached to the right side toward the front with a fastener 708. The third semi-rigid member on the right side 706 is constructed from the loop component of a hook and loop pair, with the loop component facing towards the bag.

When the bag is in the single-strap mode, the first and third semi-rigid members on the right side 702 and 706 overlap each other and are mated. This constrains both strap segments 108 and 110 on the right side to lie flat against the right side with the outside strap segment 108 lying on top of the inside strap segment and the inside strap segment lying against the bag so the two strap segments on the right side appear to a causal observer as a single strap. When the bag is in the single-strap mode, the strap segments on the right side may slide up and down, but are otherwise constrained to lie against the right side.

The composite member 116L on the left side is shown in FIG. 7L1 when the bag is in the single-strap mode. It is constructed of three semi-rigid members on the left side 710, 712 and 714. The first semi-rigid member on the left side 710 is fastened to the left side 120 toward the front 136 with fastener 414, and the other end attached to the left side towards the back with a fastener 716. It constrains the inside strap segment 110 to lie against the left side of the bag, but allows the strap segment to slide up and down. The second semi-rigid member on the left side 712 is attached to the left side toward the front with the fastener 414; with the second semi rigid member lying on top of the first rigid member. The second semi-rigid member on the left side 712 is constructed from the loop component of a hook and loop pair, with the hook component facing away from the bag. The third semi-rigid member on the left side 714 is constructed from the loop component of a hook and loop pair, with the loop component facing towards from the bag.

When the bag is in the single-strap mode, the second and third semi-rigid member on the left side 712 and 714 overlap each other and are mated while containing the outside strap segment 108. This constrains both strap segments 108 and 110 on the left side to lie flat against the left side with the outside strap segment 108 laying on top of the inside strap segment 110 and the inside strap segment lying flat against the bag so the two strap segment on the left side appear to a causal observer as a single strap. When the bag is in the single-strap mode, the strap segments on the left side may slide up and down, but are otherwise constrained to lie against the left side.

FIG. 8R1 shows a perspective view of the composite member 116R for the right side and FIG. 8L1 shows a perspective view of the composite member 116L for the left side when the bag is in the single-strap mode. The composite members 116R and 116L are positioned on the right side and the left side respectively near the top of the bag. In this case the hook and loop pairs 702 and 706 on the right side are mated and the hook and loop pairs 712 and 714 on the left side are mated so the composite members 116R and 116L constrain the strap segments 108 and 110 to lie against the sides of the bag on both sides.

FIGS. 7R2 and 7L2 show the right side and left side respectively when the bag is being transitioned into the backpack mode. The hook and loop pair on the right side 702 and 706 are released and the inside strap segment 110 on the right side is free to move away from the bag. The hook and loop pair on the left side 712 and 714 are released and the outside strap segment 108 on the left side is free to move away from the bag.

FIG. 8R2 shows a perspective view of the strap releasable constraining member 116L for the right side 114 and FIG. 8L2 shows a perspective view of the strap composite member 116L for the left side 120 when the bag is in transition between the single-strap mode and the backpack mode.

Operation

The operation of the second embodiment follows that of the first embodiment.

Third Embodiment

The following description is of the third embodiment of the invention. The only difference between the third embodiment and the first embodiment is that it has a different implementation of the right and left composite members 116R and 116L.

FIGS. 9R1 and 9L1 show the right side and left side composite members 116R and 116L respectively when they are configured for the single-strap mode. The right side composite member is composed of an inside component 902 and an outside component 906. The outside and inside components are hinged 910 so it can be closed when in the single-strap mode or opened to transition the bag to the backpack mode as shown in FIG. 9R2. The outside component 906 has a rectangular slot 920 that will constrain the outside strap 108 on the right side. The inside component 902 has a rectangular cavity 924 so that when in the single-strap mode the inside strap component 110 on the right side will be constrained to lie within the cavity; but will release the inside strap component 110 when it transitions to the backpack mode.

The right side composite member 116R has a release mechanism for keeping the composite member closed, but will allow it to open temporarily when activated by the user. FIG. 10R1 shows a cross-section of the release mechanism when the composite member is closed. FIG. 10R2 shows a cross-section of the release mechanism when the composite member is open. FIG. 11 shows a detailed perspective view of the pin and the slide. The release mechanism is comprised of a slotted pin 916 attached to the inside component 902 at the end opposite the end that has the hinge, a slide 912, a slide frame 914 that is part of the outside component 906 and constrains the slide, and a spring 1002. The slide frame allows the slide to move in a direction away from the hinge when the slide is pushed only by the spring, but towards the hinge when pushed by a user's finger; yet constraining the slide to remain within the frame.

FIGS. 10R1 and 10R2 are cross-section views that show how this release mechanism works. The frame 914 constrains the slide 912 and allows it to slide in the direction of the longitudinal axis of the composite member. The slide 912 is pushed by the spring 1002 so it engages the notch 1008 on the slotted pin 916 and prevents the composite member from opening. To release the outside component 906, the user pushes the slide 912 in and holds it while the outside component is lifted. The slide has a rectangular opening 1004 that allows the pin to pass through. The slide also has a protuberance 1006 that fits in a recessed channel 1007 embedded in the frame 914.

FIGS. 9L1 and 9L2 show the left side composite member 116L. It is composed of a outside component 908 and an inside component 904. It is designed similar to the right side composite member; the main difference is that the constraining slot 922 is in the inside component and the restraining cavity 926 is in the outside component. The release mechanism on the left side has the same implementation as the release mechanism on the right side.

FIGS. 12R1 and 12R2 present perspective views of the right side composite member when the bag is in the single-strap mode and is transitioning to the backpack mode respectively. FIGS. 12L1 and 12L2 present perspective views of the left composite member 116L when the bag is in the single-strap mode and is transitioning to the backpack mode. Although the implementation is different, the composite members of this embodiment perform the same function as the composite members of embodiment one and two.

Referring to FIGS. 9R1 and 9R2, there are two circular holes 918 through the inside 902 of the right side that will allow fasteners to be used to attach the right side composite member to the right side. There are four circular holes 919T and 919B on the inside 904 of the composite member on the left side. The holes are positioned and sized so two of the holes 919B will allow the composite member to be attached to the bag and the other two holes 919T are larger so they will allow the fasteners to pass through to the inside holes during installation of the composite member to the bag.

Operation

The operation of the third embodiment is the same as the first embodiment and will not be repeated.

Fourth Embodiment

The following description is of the fourth embodiment. This embodiment adds the following enhancements to embodiment two: shoulder pads, a stabilizing sleeve on the right side, strap rotational mechanisms on the side/back of the bag and a modified left side bag attachment mechanism that adds a side handle to the bag and prevents the left side strap segments from sliding through the left side attachment member.

The shoulder pads 1302O and 1302I are designed to have the following characteristics. There are two shoulder pads, one fitting on each strap segment. They are flexible so they can fit naturally around the shoulders under the weight of the bag for all applicable modes. When in the single strap mode the outside shoulder pads sits on top of the inside shoulder pad. They are attached to each other so they appear as a single pad. When transitioning from the single-strap mode to the backpack, the shoulder pads are pulled apart. They then function as two backpack shoulder pads; one going on each shoulder. In addition, when in the single-strap mode, the pads must also accommodate flexing. The pads remain attached to each other under normal flexing.

The stabilizing sleeve 1306 prevents the strap segments on the right side from undue twisting and sliding when transitioning from one mode to another. The sleeve also has sufficient clearance so the strap segments may slide through them when adjusting the strap length.

FIGS. 13R and 13L show right side/front and left side/front perspective views of embodiment four when the bag is in the single-strap mode. The pads are held together by two sets of magnetic snaps (hidden in FIGS. 13R and 13L). FIGS. 13R and 13L also show the enhanced strap adjustment mechanism and double swivel 1308. This serves two purposes, it allows the user to adjust the length of the straps and it also allows the inside strap segment on the left side to rotate so it lies flat against the outside strap segment when in the single-strap mode, and lies flat against the user's back when in the backpack mode. In FIGS. 13L and 13R the double swivels are aligned so that the inside strap segment lies flat against the outside strap segment on the left side.

FIG. 13R also shows the stabilizing sleeve 1306. This sleeve, having the shape of a flattened tube, fits around the strap segments on the right side above the right side attachment component 124R so it holds the two strap segments snugly so the strap segments won't twist unnecessarily as the bag transitions from one mode to another. It also has sufficient clearance so the strap slides smoothly through the sleeve when strap length adjustments are made.

FIGS. 14R and 14L show back/right side and back/left side perspective views respectively of the bag when it is in the backpack mode. Here the shoulder pads 1302O and 1302I are separated from each other and are worn, one on each shoulder, in the usual manner of backpacks having shoulder pads. The double swivel 1310 on the left side is rotated so the inside strap 110 segment on the left side lies flatly against the user's back. The modified right side composite member rotates the outside strap segment on the right side so the strap on the right lies against the user's back.

FIGS. 13L and 14L also show the modified left side bag constraining member 124L. It functions in a different manner than in embodiment two. The inside and outside strap segments 108 and 110 are attached to each other on the left side above but very close to the left side single loop 122L by rivets 1314. The left side composite member of embodiment two 116L is replaced by an outside strap releasable constraining member 1312. The inside strap segment on the left side is attached to the bag near the top by rivets 1316. The strap subsegment 1318 on the left side between single loop 122L and the attachment rivets 1316 lies against the left side but allows the user to grasp it like a handle when transitioning from the backpack mode to the single-strap mode.

FIGS. 13R and 14R show the composite member 116R on the right side. In this embodiment, the third semi-rigid member 1402 on the right side has a slightly different design than the third semi-rigid member 714 on the right side of the second embodiment. It has the ability to rotate the outside strap segment 110 when the bag is in the backpack mode.

Strap rotational mechanisms are designed to rotate the left side inside strap segment and right side outside strap segment as they flow from the sides of the bag to the back of the shoulders when the bag is in the backpack mode. This capability ensures that the strap segments lay flat against the back. They also must not rotate the strap segments when in the single strap mode.

FIGS. 15L1 and 15L2 show two detailed perspective views of the first design for the strap rotational mechanism. This design incorporates the strap adjustment mechanism and double swivel 1308 in one combined system. The single loop 134 of embodiment one is replaced by a double swivel 1310 composed of a top loop 1504, a bottom loop 1506 and a pin 1508. The pin allows the top loop 1504 and bottom loop 1506 to swivel along the pin's axis. The top loop 1504 has one end of the inside strap segment going slidingly thought it, while the bottom loop 1506 has the other end of the inside strap segment attached to it. FIG. 15L1 shows the two loops aligned so the inside strap segment on the left side lies flatly against the bag when the bag is in the single strap mode, while FIG. 15L2 show the top loop rotated along the pin's axis so the strap segment above the double swivel may lay approximately flat against the user's back while the bottom component of the left strap segment lies flat against the left side.

FIGS. 15L3 and 15L4 show an alternate design for the double swivel component of the strap rotational mechanism. It consists of a top loop 1504, a pin 1508 and a bottom bar 1510. The bottom bar 1510 serve the same function as the bottom loop 1510; the only difference is the way the strap is attached to it. Rather than the strap segment 110 looping through it, the strap segment 110 has a hole in the center of the longitudinal axis of the strap segment towards its end so the pin goes through the hole and the strap and is wrapped around the pin as shown of FIG. 15L4.

The next set of figures show the second design for the strap rotational mechanism. FIGS. 15R1 and 15R2 show the cross section views of the right side composite member 116R in the single-strap mode and the backpack mode respectively. In embodiment four the third semi-rigid member on the right side 1402 has a bulge 1512 on the third semi-rigid member. As shown in FIG. 15R1, when in the single strap-mode, the bulge doesn't interfere with the containment of the inside strap segment on the right side when in the single-strap mode. However when in the backpack mode, the third semi-rigid member on the right side 1402 is placed between the second semi-rigid member on the right side 704 and the right side 114. This causes the outside strap segment on the right side to twist above the right side composite member so the outside strap segment lies flat against the user's back. FIG. 15R3 show a perspective view of the right side composite member when in the backpack mode.

FIGS. 15L5*a* and 15L5*b* show a third design for the strap rotating mechanism 1514. FIGS. 15L5*e* and 15L5*f* show the rotating mechanism when installed on the left side of the bag. These figures are all perspective left side/front views. The terms top, bottom, left right and back, when referring to this strap rotating mechanism, will be relative to these views. FIGS. 15L5*c* and 15L5*d* give perspective views of the hinge component of this strap rotating mechanism.

Referring now to FIG. 15L5*a*, the strap rotating mechanism 1514 is shown when configured for the single-strap mode. The strap rotating mechanism consists of a top component 1516T and a bottom component 1516B connected by a hinge 1524. The top component 1516T consists of a flattened tube 1518T with a slot 1522T that encloses the inside strap segment 110 but allow the strap segment to slide through it up and down, and a foot 1520T that extends from the bottom of the rectangular tube 1518T at the back. The foot 1520T is attached to the top half 1520T of a hinge 1524. The bottom component 1516B has the same design as the top component 1516T, but it is inverted. It consists of a flattened tube 1518B with an opening 1522B that can encloses the inside strap segment but allow the strap to slide through it, and a foot 1520B that extends upward from the top of the rectangular tube 1518B at the back. The foot 1520B is attached to the bottom half 1524B of a hinge 1524. When the strap rotating mechanism is in the single strap mode, the top component 1516T and bottom component 1516B lie in the same plane so the slots 1522T and 1522B are aligned to accommodate the strap segment 110 without twisting it.

FIG. 15L5*e* show a perspective view of the strap rotating mechanism 1514 installed on the left side when the bag is in the single strap mode. It contains the inside strap segment 110 and is positioned so that the bottom component 1516B lies immediately above the left side composite member 116L and lies flat against the bag. The top component 1516T lies above the top of the bag. The hinge 1524 connects the top component 1515T and bottom component 1516B.

FIG. 15L5*b* shows the strap rotating mechanism 1514 when it is rotated so it accommodates the backpack mode. The top component 1516T is rotated clockwise relative to the bottom component 1516B. FIG. 15L5*f* shows the strap rotating mechanism as the strap is being transitioned to the backpack mode. The top component 1516T is rotated so the inside strap segment 110 above the bag will lay flat against the user's back. The hinge 1524, activated by the spring, enables this rotation to occur.

As shown in 15L5*a*, 15L5*b* and 15L5*e*, the strap rotating mechanism 1514 has swivel stop component 1528 attached to the top foot 1520T at its left side towards the foot's bottom. The swivel stop component 1528 is an oblong flat plate with a pin located near one end attaching it snugly to the foot on its left side. It swivels around the pin when moved by the user, but otherwise remains in place. When the swivel stop component 1528 is in the down position, it partially overlaps the top portion of the bottom foot 1520B on the left side. This is the normal position when the strap rotating mechanism is in the single strap mode as shown in FIGS. 15L5*a* and 15L5*e*. When swivel stop component 1528 is rotated approximately 90 degrees counterclockwise, it clears the bottom foot 1520B.

FIGS. 15L5*c* and 15L5*d* show a detail view of the hinge 1524. The hinge consists of a hinge top component 1524T, a hinge bottom component 1524B, a hinge pin 1530 that rotationally connects the top and bottom hinge components and a spring that will rotate the top component relative to the bottom component up to 90 degrees clockwise when the hinge is attached to the top and bottom feet 1420T and 1520B and the feet are not constrained by the swivel stop component 1528.

Referring now to FIGS. 15L5*e* and 15Lf, the strap rotating mechanism 1514 allows the user to enable the inside strap segment 110 on the left side to be positioned properly both when the bag is in the single strap mode and when it is in the backpack mode. When in the single strap mode, the top and bottom components are aligned and the stop component 1528 in conjunction with the spring, keeps them aligned. As seen in FIG. 15L5*e*, the outside strap segment lies on top of inside strap segments, and the bag hangs nicely over a single shoulder.

As shown now in FIG. 15L5*f*, when transitioning from the single strap mode to the backpack mode, the user rotates the swivel stop 1528 so the top component rotates clockwise relative to the bottom components caused by the pressure applied by the spring. When the bag is then put over the user's shoulders in the backpack mode, the inside strap segment 110 above the bag will lay flatly against the user's back.

The description here applies to the swivel strap component 1514 on the left side of the bag. A similar component may be used on the right side of the bag. Its main difference is that it is mounted on the outside strap segment 110, and it is constructed so that it rotates in the opposite direction than that of the swivel strap component on the left side. The details of its design are straightforward and are not presented here.

In this third design, the strap rotational mechanisms fit loosely on the strap segments so they will not interfere with the strap length adjustment operation. They also will not interfere with the straps functioning when transitioning from the single strap mode to the over-the-head mode since they will slide easily along the segments.

This completes the discussion of the strap rotational mechanisms.

FIGS. 16*a*1 and 16*a*2 show the stabilizing sleeve on the right side and a detailed view of its use on the right side respectively. It is a flattened tube that contains the inside and outside strap segments on the right side, and is positioned just above the right side strap attachment member 124R. The stabilizing sleeve allows the strap to slide when adjusting the strap length, but prevents undue sliding when transitioning between the single-strap mode and the backpack mode.

FIGS. 16*b*1 and 16*b*2 show a perspective view and a cross section view of an alternate design of the stabilizing sleeve 1306. This design adds a thumbscrew 1604 to the sleeve 1602. The thumbscrew 1604 has as components a circular knob 1606, a threaded shaft 1608 and a circular stop 1610. The shaft is threaded and fits into a threaded hole 1612 on the sleeve 1602. When the thumbscrew 1604 is tightened the strap cannot slide and the inside strap segment and outside strap segment retain their length as the bag transitions between the single-strap mode and the backpack mode. When the thumbscrew is loosened, the strap length may be adjusted or the bag may be put in the over-the-head mode or allow the overall lengths of the strap segments to be adjusted.

FIGS. 17O and 17I are exploded views of the top and bottom shoulder pads respectively. Referring to FIG. 17O, the outside pad 1302O is constructed from a top non-rigid rectangular element 1708O, two side non-rigid elements 1710O, and a bottom non-rigid rectangular element 1712O. The bottom element is made of a soft flexible material such as a foam pad that will be comfortable on the user's shoulder. The top rectangular element 1708O has two rectangular openings 1706O, one near each end.

Referring now to FIG. 17I, the inside pad 1302I is constructed in a similar way, with a top non-rigid rectangular elements 1708I, two side non-rigid elements 1710I, and a bottom non-rigid rectangular element 1712I. The top rectangular element 1708I has two rectangular openings 1706I, one near each end.

The outside shoulder pad 1302O has two female magnetic snap components 1702O attached to its bottom element 1712O, one near each end. The inside shoulder pad 1302I has two male magnetic snaps 1702O, each attached to a sleeve 1704. The sleeves are constructed to fit around the inside strap segment 110.

FIG. 17*c* shows the two shoulder pads assembled and installed on the outside and inside strap segments. Each pad is constructed so the top element, the two side elements and the bottom element are permanently joined together so the strap segment will go through it as is usual for shoulder pads with straps constrained slidably within. The two female magnetic snap components 1702O are attached to the bottom element of the top pad, one toward either end. The two male magnetic snap components 1702I are each attached to a sleeve 1704. The sleeves are located within the inside shoulder pad with the inside strap segment passing through the sleeves. The sleeves and rectangular openings are located and sized so the male snap components 1702I protrude through the rectangular openings 17061 on the top 1708I of the inside shoulder pad 1302I and mate with the male snap components 1702O. The top rectangular opening serves two purposes; they permit easy installation of the outside magnetic snap components 1702O to the bottom element 1712O, and they give the outside shoulder pads a similar appearance to the bottom shoulder pad when worn in the backpack mode.

FIGS. 17*a* and 17*b* show two possible configurations of the pads when the bag is in the single-strap mode. FIG. 17*a* shows them without bends as might occur when the bag is not being worn; and FIG. 17*b* shows them curved as when they are worn over a shoulder. FIG. 17*a* also shows the location of two cross-sections FIG. 18 section and FIG. 20*a*, which are presented in FIGS. 18 and 20*a* respectively.

FIG. 18 shows a cross-section of the pads with the straps installed. The cross-section is taken perpendicular to the longitudinal axis of the pads and bisects the snap. The outside snaps 1702O are installed so that they are slightly recessed on the bottom element 1712O so they will not be felt by the user when worn in the backpack mode. The inside male snaps 1702I and sleeves 1704 are installed so they can slide along the longitudinal axis of the bottom pad while the snaps protrude through, but are contained within the rectangular opening 17061. The width and length of the rectangular openings 17061 on the bottom pad are determined so that each male snap will protrude through the opening and will slide from one end of the opening to the other as the pads flex in normal usage. The two rectangular openings are positioned as close to each end of the pad as possible without compromising the structural integrity and use of the pads.

FIG. 19 shows a detail of the male snap component 1702I, the sleeve 1704 and the inside strap 110 as installed.

FIGS. 20*a* and 20*b* show how the pads function when the bag is in the single-strap mode and they are flexed. The figures show the outside and inside pads separated for exposition purposes. In actual use, the outside pad lies directly on top of the inside pad with the snaps mated. Only one end of the pad pair is shown, the other end performs similarly. FIG. 20*a* shows the position of the snap components when the pads are straight. The male snap component is positioned towards the outer end of the rectangular opening while remaining mated to the female component. FIG. 20*b* shows the position of the snap components when the pads are curved as when worn over a shoulder. The male snap is positioned towards the end of the rectangular opening midway between the two ends. As the pad is flexed from straight to various curved shapes, the sleeve with the attached male component will move along the longitudinal component of the inside pad so the snap pairs continue to mate.

Figure 21B:
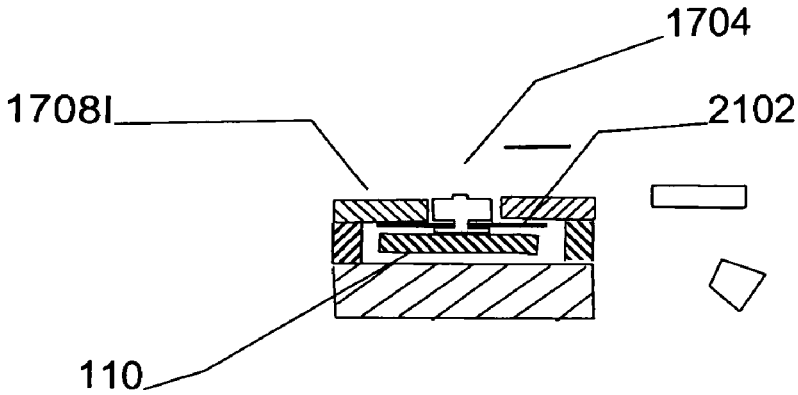

FIG. 21*a* shows an alternate design for mounting the male snap components. In this design the sleeve 1704 is replaced by a thin rigid rectangular element 2102. The male snap components are each fastened to a rigid thin element 2102. The thin rectangular element 2102 has approximately the same width of the strap width and a length approximately double the length of the rectangular opening 17061. The thin rectangular element 2102 with the mail snap 1704 attached is installed above and adjacent to the inside strap segment 110 as shown in FIG. 21*b*. The top semi-rigid element 17081 constrains the male snap to stay within the shoulder pad but would allow the snap to move along the pad's longitudinal axis while remaining constrained to lie within the rectangular opening.

The fourth embodiment gives a specific design for implementing the shoulder pads. There are many alternate ways to implement this functionality. The actual pad construction may be done in various ways: constructed using the elements shown; or molded as a single unit. If built up from separate elements, they can be joined by various means such as adhesive, sewing or rivets. The design can be slimmed down to a much smaller size if used for a small purse rather than a computer bag. The magnetic snaps could be replaced by various mechanisms such as, but not limited to, ordinary snaps or hook and loop pairs. The next embodiment will show one of these alternate designs Operation FIGS. 22*a* through 22*e* show the fourth embodiment as a user transitions the strap apparatus from the single-strap mode to the backpack mode.

Figures 22A, 22B, 22C, 22D, 22E:
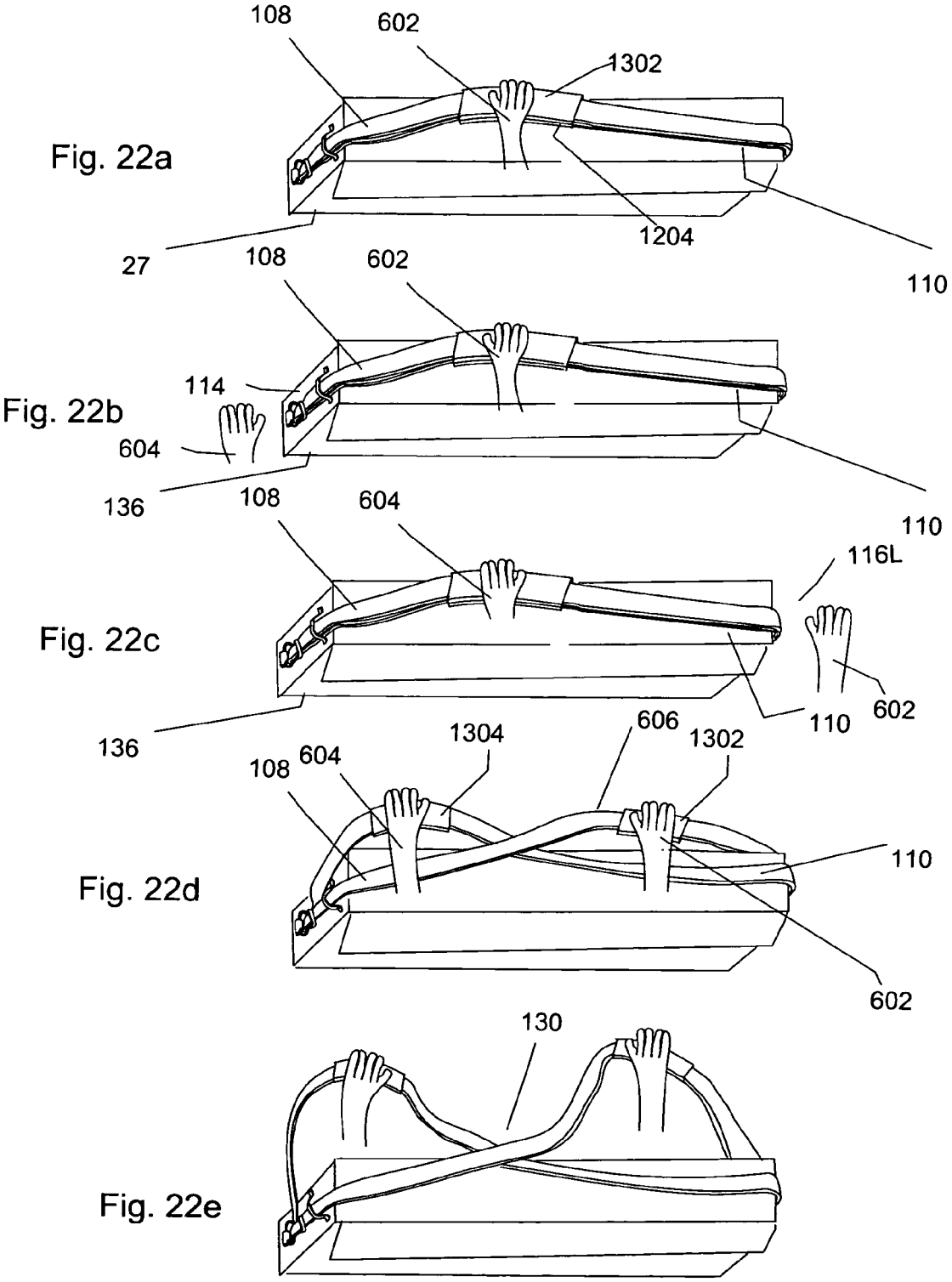

FIG. 22*a* shows the bag in the single-strap mode. To convert to the backpack mode, the user grabs the two pads 1302O and 1302I with the right hand 602 holding them together and picks up the bag so the bag hangs with the bag's bottom approximately parallel to the floor, the bag hanging in front of the user and the front 136 facing the user.

Referring now to FIG. 22*b*, the user then detaches the detachable connector 116R on the right side 114 with the left hand 604, releases the inside strap segment 110 and then re-attaches the detachable connector 116R.

Referring to FIG. 22*c*, the user then holds the two pads with the left hand, detaches the left side releasable constraining member 1312 (hidden in the figure) on the left side 114 with the right hand 602, releases the outside strap segment 108 and then reattaches the releasable constraining member 1312.

As shown in FIG. 22*d*, the user then grabs the outside pad 1302O with the right hand 602, and grabs the inside pad 1302I with the left hand 604 and pulls them apart. The user's hands are positioned above each pad with palms down.

As shown in FIG. 22*e*, the user then puts on the bag as one does with a backpack by putting the inside pad 1302I over the left shoulder and the outside pad 1302O over the right shoulder so the bag hang on the back of the user and the two strap segments cross at the back 130 of the user.

To convert the bag from a backpack mode to a single-strap mode, the user reverses these steps. To convert the bag from the single-strap mode to a dual-strap mode, the user puts on the bag in the single-strap mode. If the straps are on the user's left shoulder then the user grabs the outside strap 108 with the left hand and moves the outside strap over the user's head to the right shoulder. If the straps are on the user's left shoulder then the user grabs the outside strap with the right hand and moves the first strap over the user's head to the right shoulder.

This completes the description of the fourth embodiment of the invention.

Fifth Embodiment

The following description is of the fifth embodiment. It is a variation of the fourth embodiment where the shoulder pads of the fourth embodiment are replaced by shoulder pads of a different design. This embodiment is best used on bag designs, which do not require shoulder pads such as a purse, promotional bag or lightweight messenger bag. Therefore, rather than providing a cushion for the user's shoulder, their primary function is to keep the outside and inside strap segments together when in the single-strap mode but allow them to be separated when in the backpack mode.

Referring now to FIG. 23, the top shoulder pad consists of two thin flattened tubes of flexible but thin material 2302 and 2304 that fit around the outside strap segment 108 and inside strap segment 110 respectively. The tubes will fit around each strap segment snugly so they stay in their position on the strap when left alone, but will slide easily when moved by the user. The lengths of the two tubes are each approximately several times the width of the strap segments. The outside tube 2302O has two strips of loop components of a hook and loop pair, one strip near each end of the tube and mounted on the bottom of the tube. The inside tube 2302I has two strips of hook components of a hook and loop pair, one strip near each end of the tube and mounted on the top of the tube. The two hook and loop pairs are positioned so that when the two tubes are placed together, they will mate and hold the strap segments in the single-strap mode. When they are pulled apart, the bag may be positioned in the backpack mode.

The operation of the embodiment is essentially the same as embodiment four and will not be repeated here.

Sixth Embodiment

The following description is of the sixth embodiment of the invention.

FIGS. 24R and 24L depict the right side 114/front 136 and the left side 120/back 138 views respectively of the sixth embodiment in the single-strap mode. FIG. 25 shows the left side/back view when the bag is in the backpack mode with the two straps crossing at a location 130 at the back of the user when worn as a backpack. FIGS. 26*a* and 26*b* show the right side/front view of the bag when it is in the over-the-head mode and in the dual-strap mode respectively.

The sixth embodiment differs from the first embodiment as follows: In embodiment one, the outside strap segment 108 and inside strap segment 110 remain together, one on top of the other, so they appear as a single-strap to the casual observer when in the single-strap mode. In embodiment six the front strap segment 2402 and back strap segment 2404 are separated and appear as two separate straps, one segment positioned towards the front of the bag and the other segment positioned towards the back of the bag. Composite members for right and left sides 2407R and 2407L replace the right side composite member 116R and the left side composite member 116L of embodiment one. The composite members 2407R and 2407L are attached to the right side 114 and left side 120 by fasteners 2412R and 2412L respectively, shown in FIGS. 27R1 and 27R2. Embodiment one typically will have wide straps e.g. 3.8 centimeters (1½ inches) while the embodiment six has narrow straps, e.g. 1.3 centimeters (½ inch).

FIG. 27R shows the composite member 2407R for the right side. The composite member 2407L for the left side has the same design. They are mounted so the releasable constraining component 2408R on the right side is positioned toward the back of the bag while the releasable constraining component 2408L of the left side is towards the front of the bag.

FIGS. 27R1 and 27L1 show a perspective view of the right side composite member 2407R and left side composite member 2407L, together with the two strap segments 2402 and 2404 that are constrained by the composite members when the bag is in the single-strap mode. FIGS. 27R2 and 27L2 show the composite member components for the right side and left side 2407R and 2407L respectively when the front strap segment 2402 is constrained on the right side and is away from the bag on the left side, and the strap segment 2404 is constrained on the left side and is away from the bag on the right side so the bag may be put in the backpack mode.

The composite member 2407R, mounted on the right side, is constructed so it has a releasable constraining component 2408R and a constraining component 2410R. The releasable constraining component 2408R constrains the back strap segment 2404 when it is in the single-strap mode. It has spring so the user can release the strap from the constraint when the user forces it open; and snaps back once the user releases it. The constraining component 2410R constrains the front strap segment 2402 but lets it slide up and down.

The composite members 2407L, mounted on the left side, is constructed so it has a releasable constraining component 2408L and a constraining component 2410L. The releasable constraining component 2408L constrains the front strap segment 2402 when it is in the single-strap mode, but is has spring so it the user can release the strap from the constraint when the user forces it open; and it snaps back once the user releases it. The constraining component 2410L constrains the back strap segment 2402 but lets it slide up and down.

Operation

The method of transitioning among the modes of the sixth embodiment is similar to that of embodiment one. When the embodiment is in the single-strap mode both strap segments are constrained to lie next to the bag sides by the composite members 2407R and 2407L. To transition the bag to the backpack mode, the releasable constraining components 2408R and 2408L are each flexed so the user can release the back strap segment on the right side 2404 and the front strap segment on the left side 2402 from the constraints. Then the user, with the bag held in front of him with the front of the bag facing him, grabs the front strap segment 2402 with the left hand at the top of the strap segment, and grabs the back strap segment 2404 with the right hand at the top of the strap segment. The user then lifts the bag by the strap segments; one in each hand. The bag then positions itself to be put on as a backpack. To put it back into the single-strap mode, this process is reversed. Putting the bag in the dual-strap mode and in the over-the head mode are also achieved in a manner similar to embodiment one.

Discussion of Embodiment Six

Various extension and modifications of the sixth embodiment are possible. The embodiment may be modified to have adjustment mechanisms added; the attachment components to the bag 2406L and 2406RL may be modified in various ways; for example having two loops replacing each of 2406R and 2406L so the straps will lie parallel to each other when against the bag in the single-strap mode. The composite elements 2407R and 2407L may each be replaced by two separate components, one that performs the constraining function; the other performs the releasable constraining function.

As an alternate design, the composite members 2407R and 2407L may be positioned on the sides so the releasable constraining members 2408R and 2408L both point towards the back of the bag. In this case the strap segments will cross at the top of the bag when in the single strap mode.

This completes the description of the sixth embodiment.

Seventh Embodiment

The following description is of the seventh embodiment of the invention.

FIGS. 28R and 28L depict the right side 114/front 136 and the left side 120/back 138 views respectively of the seventh embodiment in the single-strap mode. FIG. 29 shows the left side/back view when the bag is in the backpack mode with the two straps crossing at a location 130 at the back of the user when worn as a backpack.

The seventh embodiment differs from the sixth embodiment as follows: In embodiment six, the front strap segment 2402 and back strap segment 2404 are constructed out of a single length of strap. In embodiment seven the front strap segment 2802 and back strap segment 2804 consist of two separate straps, one segment is positioned towards the front of the bag and the other segment towards the back of the bag. Composite members for right and left sides 2408R and 2R08L of embodiment seven have the same design and mounting as in embodiment six. Similarly the right and left side constraining members 2406R and 2406L have the same design and mounting as in embodiment six.

In embodiment seven, the ends of the front strap segment 2802 are permanently attached to the composite member 2407R at the constraining component 2410R on the right side and the constraining member on the left side 2406L. Similarly, the ends of the back strap segment 2804 are permanently attached to the composite member 2407L on the constraining component 2418L on the left side and the constraining member on the right side 2406R. In embodiment seven, the relative strap lengths are not adjustable, but otherwise perform in the same manner as embodiment six. If strap lengths adjustment capability is desired, then two strap adjustment mechanisms may be added, one on the front strap segment 2802 and the other one the back strap segment 2804.

Operation

The operation of embodiment seven is the same as embodiment six. The only difference is that embodiment seven doesn't have a long strap mode.

CONCLUSIONS, RAMIFICATIONS AND SCOPE

FIG. 20 summarizes the four modes of my invention, selected from the various embodiments. These embodiments are not the only embodiments of my invention.

While my above description contains many specificities, these should not be construed as limitations on the scope of the invention, but rather as an exemplification of the seven presently preferred embodiments thereof. Many other ramifications and variations are possible within the teachings of the various embodiments.

For example,

- Various subsets of the four modes may be implemented such as implementing only the single-strap and dual-strap modes on a bag.
- Different designs for the shoulder pads may be implemented depending on the size and design of the bag and various feature/price tradeoffs.
- A rope-shaped strap, a chain or any other strap type used for carrying bags may be used as a strap, which is shown in these embodiments as a flat strap.
- The fasteners are shown in the embodiments as rivets. Any attachment mechanism may be used such as, but not limited to, rivets, sewing, gluing, or fusion.
- The releasable connectors may be of any type such as, but not limited to, snaps, hook and loop, or magnetic snaps.
- In any of the embodiment the strap adjustment mechanisms may be eliminated or included, and if included may have one or two.
- The strap adjustment components may be placed at the bottom of the bag instead of on the sides.
- Composite members may be redesigned to have separate components rather than composite components.
- The various features presented in the embodiments given above and discussed in this section may be mixed and/or matched to create new embodiments.
- Removable or permanent training guides, such as hand positioning prompts, may be installed on the strap apparatus to assist a new user in learning how transition the strap apparatus among the various modes. The shoulder pads would be an ideal place to install such guides.
- The assignment of specific attributes to the left side, right side, outside and inside is strictly for definitiveness of the embodiments and may be permuted as appropriate. For example the left and composite member may be installed on the right side, and the right side may be installed on the left side. The strap adjustment mechanism may be on either side of the bag and may be positioned on the outside or inside strap segment.
- The actual design of the bag is arbitrary provided it accommodates the features in the invention. It may have one or two carrying handles at the top. If the bag is composed of non-rigid materials, the sides of the bag may require stiffeners.

Thus the scope of the invention should be determined by the appended claims and their legal equivalents, and not by the examples given.

I claim:

1. A carrying bag with a strap apparatus comprising:

(a) a first side, a second side, a front, a back, a bottom and a top, (b) a first strap segment and a second strap segment, (c) a plurality of constraining means comprising:

i. a first constraining means attached to said first side near said bottom, said first constraining means constraining said first strap segment and said second strap segment;

ii. a second constraining means attached to said second side near said bottom, said second constraining means constraining said first strap segment;

iii. a third constraining means attached to said first side near said top, said third constraining means constraining said first strap segment; and iv. a fourth constraining means attached to said second side near said top, said fourth constraining means constraining said second strap segment, (d) a first releasably constraining means being attached to said first side near said top and releasably constraining said second strap segment, (e) a second releasably constraining means being attached to said second side near said top and releasably constraining said first strap segment, (f) said first strap segment extending from said first constraining means to said third constraining means, then extending optionally to said second releasably constraining means, and then extending to said second constraining means, (g) said second strap segment extending from said first constraining means and optionally to said first releasably constraining means and then extending to said fourth constraining means, whereby said carrying bag having a single-strap mode activated by:

i. constraining said second strap segment on said first side with said first releasable constraining means, ii. constraining said first strap segment on said second side with said second releasable constraining means, iii. wearing said first and said second strap segments over a first shoulder or a second shoulder of a user so that said carrying bag hangs from said first shoulder or said second shoulder by said strap apparatus and is worn as a single-strap shoulder bag, and whereby said carrying bag having a backpack mode activated by:

i. releasing said first strap segment on said second side with said second releasable constraining means, ii. releasing said second strap segment on said first side with said first releasable constraining means, iii. wearing said first strap segment on said first shoulder, wearing said second strap segment on said second shoulder, with said carrying bag being positioned behind the user with the said first and said second strap segments crossing at said back side of said user so that said carrying bag is worn as a backpack.

2. The carrying bag with a strap apparatus of claim 1 wherein (a) said first strap segment and said second strap segment is composed of a single strap, (b) said first constraining means comprising a single loop and an attachment means attaching said single loop to said first side, (c) said single strap passing slidingly through said single loop thereby dividing said single strap into said first strap segment and said second strap segment, (d) said third constraining means slidingly constraining said first strap segment, (e) said single strap having a strap adjustment means that adjusts the length of said single strap, (f) said strap apparatus enabling the adjusting of the relative lengths of said first and said second strap segments by sliding said single strap though said single loop.

3. The carrying bag with a strap apparatus of claim 1, having a dual-strap mode activated by:

(a) constraining said first and said second strap segments to said carrying bag as in said single strap mode, (b) placing said first strap segment over one shoulder of said user and placing said second strap segment over the opposite shoulder of said user so said carrying bag hangs at said user's back side.

4. The carrying bag with a strap apparatus of claim 1, having an over-the-head mode activated by configuring said carrying bag in said single-strap mode, extending said first strap segment to a maximum length so that said second strap segment has a minimum length, whereby said first strap segment may be worn over one shoulder of said user and said carrying bag is positioned at a side of said user where said other shoulder is.

5. The carrying bag with a strap apparatus of claim 1 wherein (a) said first strap segment and said second strap segment are made of a flat strap material, and (b) when said carrying bag is worn in said single-strap mode, then i. said first strap segment on said first side, being constrained by said third constraining means, is positioned directly on top of said second strap segment on said first side being constrained by said first releasably constraining means, and said second strap segment on said first side is positioned flatly against said first side, and ii. said first strap segment on said second side, being constrained by said second releasably constraining means, is positioned directly on top of said second strap segment on said second side being constrained by said fourth constraining means, and said second strap segment on said second side is positioned flatly against said second side, and iii. said first strap segments is positioned on top of said second shoulder strap segment, said second strap segment is positioned directly on said first shoulder or said second shoulder of said user whereby when said carrying bag appears as a carrying bag supported by a single strap.

6. The carrying bag with a strap apparatus of claim 5 additionally comprising a pair of shoulder pads comprising:

(a) a first shoulder pad comprising a first top and a first bottom, (b) a second shoulder pad comprising a second top and a second bottom, (c) said first shoulder pad being slidingly attached to said first strap segment being positioned between said third constraining means and said second releasable constraining means when said carrying bag is in said single-strap mode, (d) said second shoulder pad being slidingly attached to said second strap segment positioned between said first releasably constraining means and said fourth constraining means when said carrying bag is in said single-strap mode, (e) a releasable attachment means releasably attaching said first bottom of said first shoulder pad to said second top of said second shoulder pad, said first and said second shoulder pads being positioned on said first and said second strap segments so that:

i. when said carrying bag is in said single-strap mode and is worn by said user, said first shoulder pad said first bottom is positioned directly on top of said second shoulder pad said second top and is attached to said second shoulder pad said second top, said second shoulder pad said second bottom being positioned on said user's said first shoulder or said user's said second shoulder, and ii. when said carrying bag is in said backpack mode, said releasable attachment means releasing said first and said second shoulder pads so said shoulder pads are positioned one on each of said shoulders of user.

7. The carrying bag and a strap apparatus of claim 6 additionally comprising shoulder pad adjusting means for said first and said second shoulder pads so when said first and said second shoulder pads flex while in said single-strap mode, said first shoulder pad remains positioned essentially directly on top of said second shoulder pad and remains attached to said second shoulder pad.

8. The carrying bag with a strap apparatus of claim 5 further comprising:

(a) a means for rotating said first strap segment so that i. when carrying bag is being worn in said single-strap mode, then said first strap segment is not rotated, and ii. when said carrying bag is being worn in said backpack mode, then said first strap segment is rotated so said first strap segment is positioned approximately flatly against said user's back, (b) a means for rotating said second strap so that:

i. when said carrying bag is being worn in said single-strap mode, then said second strap segment is not rotated, and ii. when said carrying bag is being worn in said backpack mode, then said second strap segment is rotated so said second strap segment is positioned approximately flatly against said user's back, (c) a lifting means on said second side so said carrying bag may be conveniently lifted by said user when transitioning from said backpack mode to said single-strap mode, and (d) a strap stabilizing means for additionally constraining said second strap segment and said first strap segment on said first side so said first and said second strap segments slide smoothly when adjusting said strap lengths, but retains said lengths when transitioning from said single-strap mode to said backpack mode and from said backpack mode to said single-strap mode.

9. The carrying bag with a strap apparatus of claim 5 wherein said first and said second strap segments are of width approximately between one centimeter (one half inch) and 5 centimeters (two inches).

* * * * *